US006393226B1

(12) United States Patent
Charlebois et al.

(10) Patent No.: US 6,393,226 B1
(45) Date of Patent: May 21, 2002

(54) INTERMEDIATE TRANSFER MEMBER HAVING A STIFFENING LAYER AND METHOD OF USING

(75) Inventors: Robert Charlebois; Arun Chowdry, both of Rochester; Craig M. Cody, Scottsville; Earl Gomes, Rochester; Dennis Grabb, Sodus; Diane M. Herrick, Rochester; Bonnie Patterson, Rochester; Dean R. Smith, Rochester; Kenneth E. Stack, Rochester; Biao Tan, Rochester; Thomas Tombs, Brockport; Joseph A. Pavlisko, Pittsford, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/679,113

(22) Filed: Oct. 4, 2000

(51) Int. Cl.[7] ..... G03G 15/16
(52) U.S. Cl. ..... 399/12; 399/308; 492/49
(58) Field of Search ..... 399/302, 308, 399/12; 430/126; 428/909; 492/48, 49, 50, 51, 52

(56) References Cited

U.S. PATENT DOCUMENTS

| | | | | | |
|---|---|---|---|---|---|
| 1,322,843 | A | * | 11/1919 | Townsend | |
| 1,457,781 | A | * | 6/1923 | Loughead | |
| 2,721,601 | A | * | 10/1955 | Spencer | |
| 2,782,459 | A | * | 2/1957 | Moncrieff | |
| 2,980,474 | A | * | 4/1961 | Gargan | |
| 2,988,387 | A | * | 6/1961 | Eschmann et al. | |
| 3,647,589 | A | * | 3/1972 | Felden | 156/165 |
| 3,846,901 | A | * | 11/1974 | Lovett | 29/450 |
| 4,119,032 | A | * | 10/1978 | Hollis | 101/216 |
| 4,344,700 | A | * | 8/1982 | Kasama et al. | 355/3 SC |
| 4,381,709 | A | * | 5/1983 | Katz | 101/375 |
| 4,503,769 | A | * | 3/1985 | Andersen | 101/153 |
| 4,599,783 | A | * | 7/1986 | Ceccacci | 29/450 |
| 4,823,160 | A | * | 4/1989 | Ikuta et al. | 355/3 DR |
| 4,903,597 | A | * | 2/1990 | Hoage et al. | 101/401.1 |
| 4,913,048 | A | * | 4/1990 | Tittgemeyer | 101/141 |
| 5,101,726 | A | * | 4/1992 | Lubke et al. | 101/216 |
| 5,241,905 | A | * | 9/1993 | Guaraldi et al. | 101/216 |
| 5,298,956 | A | * | 3/1994 | Mammino et al. | 399/308 |
| 5,415,961 | A | * | 5/1995 | Yu et al. | 430/58 |
| 5,518,854 | A | * | 5/1996 | Yu et al. | 430/133 |
| 5,600,423 | A | * | 2/1997 | Miyashiro et al. | 399/313 |
| 5,807,651 | A | * | 9/1998 | Rimai et al. | 399/302 X |
| 5,890,395 | A | * | 4/1999 | Kawata et al. | 74/431 |
| 5,895,529 | A | * | 4/1999 | Foley et al. | 118/423 |
| 5,937,244 | A | * | 8/1999 | Yoda et al. | 399/159 |
| 5,960,236 | A | * | 9/1999 | Zaman et al. | 399/91 |
| 6,016,409 | A | * | 1/2000 | Beard et al. | 399/33 |

FOREIGN PATENT DOCUMENTS

| | | | | |
|---|---|---|---|---|
| EP | 0 246 627 | * | 11/1987 | G03G/15/00 |
| EP | 0 590 924 A1 | * | 4/1994 | G03G/15/00 |
| JP | 11-38779 | * | 2/1999 | |

OTHER PUBLICATIONS

"A Nonlinear Finite Element Model of Axial Variation in Nip Mechanics With Application to Conical Rollers," by Kenneth D. Stack, Submitted in Partial Fulfillment of the Requirements for the Degree Doctor of Philosophy, Department of Mechanical Engineering, The College School of Engineering and Applied Sciences, University of Rochester, NY, 1995.

* cited by examiner

*Primary Examiner*—Joan Pendegrass

(57) ABSTRACT

An intermediate transfer member (IT) roller for use in an electrostatographic recording apparatus comprising a core member; a compliant layer covering the core member; and a stiffening layer covering the compliant layer, wherein the stiffening layer includes an endless belt that has a thickness in the range of greater than 50 and up to 1000 micrometers.

29 Claims, 6 Drawing Sheets

INTERMEDIATE TRANSFER MEMBER HAVING A STIFFENING LAYER AND METHOD OF USING

CROSS REFERENCE TO RELATED APPLICATIONS

Reference is made to the commonly assigned U.S. Patent Applications, the disclosures of which are incorporated herein by reference.

U.S. patent application Ser. No. 09/679,177, filed Oct. 4, 2000, in the names of Muhammed Aslam et al, entitled SLEEVED ROLLERS FOR USE IN A FUSING STATION EMPLOYING AN INTERNALLY HEATED FUSER ROLLER.

U.S. patent application Ser. No. 09/679,345, filed Oct. 4, 2000, in the names of Jiann-Hsing Chen et al, entitled EXTERNALLY HEATED DEFORMABLE FUSER ROLLER.

U.S. patent application Ser. No. 09/680,133, filed Oct. 4, 2000, in the names of Arun Chowdry et al, entitled SLEEVED PHOTOCONDUCTIVE MEMBER AND METHOD OF MAKING.

U.S. patent application Ser. No. 09/680,135, filed Oct. 4, 2000, in the names of Jiann-Hsing Chen et al, entitled TONER FUSING STATION HAVING AN INTERNALLY HEATED FUSER ROLLER.

U.S. patent application Ser. No. 09/680,139, filed Oct. 4, 2000, in the names of Robert Charlebois et al, entitled INTERMEDIATE TRANSFER MEMBER WITH A REPLACEABLE SLEEVE AND METHOD OF USING SAME.

FIELD OF THE INVENTION

This invention relates to electrostatography and more particularly to a reproduction method and apparatus that employs transfers of toner images to and from intermediate transfer members.

BACKGROUND OF THE INVENTION

In a multicolor electrophotographic (EP) reproduction apparatus, such as described in Tombs and Benwood, U.S. Pat. No. 6,075,965 including two or more single color image forming stations, a toner image is first electrostatically transferred from a moving primary image-forming member (PIFM), e.g., a photoconductor (PC), to a moving intermediate transfer member (ITM), and then subsequently electrostatically transferred from an ITM to a moving paper receiver sheet adhered to a transport web, employing a pressure transfer roller (PTR) located behind the transport web. The two toner transfers of each single color image take place in pressure nips respectively formed between PIFM and ITM, and between ITM and receiver sheet. The single color toner images from each of the two or more single color image forming stations are laid down one upon the other to produce, for example, a four-color toner image on a receiver sheet. In order to achieve a superior image quality, an important desire of a multicolor reproduction apparatus is good registration of the individual single color images on a receiver sheet. Moreover, it is highly desirable to minimize registration errors between individual single color images, such as may be caused by physical or mechanical effects associated with relative motions between the members.

As disclosed by Rimai et. al., U.S. Pat. No. 5,084,735 (1992), and by Zaretsky and Gomes, U.S. Pat. No. 5,370,961 (1994), a compliant intermediate transfer member (ITM) roller including a thick compliant layer and a relatively thin release layer improves the quality of electrostatic transfer of dry toner particles, as compared to the quality obtained using non-compliant intermediate transfer members, e.g., hard rollers. Not only is transfer improved from a primary image forming roller to a compliant ITM roller, but transfer is also much improved from the ITM roller to a receiver sheet.

Zaretsky, U.S. Pat. No. 5,187,526 (1993) discloses that electrostatic transfer of toner from an ITM roller to a receiver can be improved by separately specifying the electrical resistivities of the ITM and the TBR.

Bucks et. al., U.S. Pat. No. 5,701,567 (1997) describe an ITM roller having electrodes embedded in a compliant blanket to spatially control the applied transfer field.

May and Tombs, U.S. Pat. No. 5,715,505 (1998) and U.S. Pat. No. 5,828,931 (1998), describe a compliant imaging member including a thick compliant blanket coated with a thin photoconductive material.

The above mentioned patents describe benefits of using transfer rollers including a compliant layer. However, when one or more compliant ITM roller is used in an apparatus employing serial transfers of individual color toner images in succession to a receiver sheet, accurate registration in a resulting multicolor print can be more difficult to achieve.

It is well known that pressure nips formed by frictionally driven rollers coated with elastomers can exhibit a phenomenon known as overdrive (speed variations induced by strain changes). Compression of a solid elastomeric coating on a roller in a pressure nip produces a strain that changes the circumference of the roller, generally resulting in a changed surface speed in the nip. In the case of two elastomerically-coated rollers each of a different elastomer, with one roller frictionally driving the other, the result is to change the rotation rate of the driven roller as compared to its rotation rate in the hypothetical situation in which both rollers are nondeformable.

It will be evident that in a multicolor EP reproduction apparatus, e.g., such as described in U.S. Pat. No. 6,075,965 cited above, there will be variations in the precision with which the different rollers in the two or more single color image forming stations can be manufactured. There will also be variations in the precision of mounting of the roller members in the apparatus. Unless costly precautions are taken for manufacturing the rollers and for providing precision mechanisms for mounting them, even small variations will tend to produce significant differences in the amounts of overdrive developed by the various pressure nips in the apparatus. These differences can produce noticeable flosses of overall registration between different single color toner images on a receiver. The degree of strain induced speed variation in a pressure nip is also dependent upon the engagement, the strain generally tending to become greater as the engagement is increased. Speed variations associated with sets of elastomerically-coated rollers, such as rollers disclosed in U.S. Pat. No. 6,075,965 cited above, can vary due to changes of engagement associated with the flexing of rollers, thermal changes, drag force fluctuations, vibrations, and so forth. Moreover, variations in overdrive, sometimes referred to as "differential overdrive", can occur along the length of a given transfer nip. Differential overdrive can be caused, for example, by local changes in engagement produced by variations of dimensions of the members forming a transfer nip, e.g., by roller runout, or by lack of parallelism of roller axes. Runout is defined here as the maximum radius measured from the axis of rotation of the core member minus the minimum radius measured from the axis of rotation of the core member, as measured over the entire operational length of the substantially cylindrical portion of the core member. Differential overdrive can result in a locally variable degree of slippage between rollers, which can produce image artifacts, including localized areas where a transferred toner image is distorted. Distortions resulting from differential overdrive in individual color separation toner images transferred sequentially to a receiver can produce a final multicolor print in which there may be localized patches in which registration is not optimal for all the colors.

In order to achieve very high quality color rendition including excellent registration in all areas of a print, it is necessary to provide improved means for controlling variations of overdrive from station to station in a color reproduction apparatus, and also to provide means for controlling differential overdrive. The present invention discloses a means for accomplishing these goals, by providing an improved compliant intermediate transfer roller for which the surface velocity in a transfer nip has a reduced sensitivity to external changes, such as: engagement, tension, drag forces, temperature, vibration, and the like.

SUMMARY OF THE INVENTION

The invention is directed to providing improved intermediate transfer member rollers in a multicolor electrostatographic apparatus which utilizes successive, image forming stations, each station providing a first electrostatic transfer of a toner image from a primary-image forming member to an intermediate transfer member and a second electrostatic transfer of the toner image from the intermediate transfer member to a receiver member carried through the image forming stations on a paper transport web, the intermediate transfer members having an improved structure to minimize station-to-station variability of overdrives associated with the first and second electrostatic transfers in each station.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, relative proportions depicted or indicated of the various elements of which disclosed members are included may not be representative of the actual proportions, and some of the dimensions may be selectively exaggerated.

DETAILED DESCRIPTION OF THE PREFERRED EMBODIMENTS

Because apparatus of the type described herein are well known, the present description will be directed in particular to subject matter forming part of, or cooperating more directly with, the present invention.

The invention relates to electrophotographic full color imaging utilizing one or more single color toner images, whereby each single color toner image is formed on a primary image-forming member (PIFM), transferred in a first transfer step to a novel intermediate transfer member (ITM) including one or more compliant layers and a stiffening layer, and subsequently transferred in a second transfer step to a receiver, e.g., paper. As an alternative to electrophotographic recording, there may be used electrographic recording of each primary color image using stylus recorders or other known recording methods for recording a toner image on a PIFM which may comprise a dielectric member, the toner image to be transferred electrostatically as described herein. Broadly, the primary image is formed using electrostatography, and a PIFM may include a web or a drum.

In the prior art disclosed in Tombs and Benwood, U.S. Pat. No. 6,075,965, single color toner images are sequentially transferred in register to a receiver sheet carried on a moving transport web through a series of corresponding single color modules. Each single color module comprises a rotating compliant ITM roller and a counter-rotating PIFM roller. In each module, the moving transport web can frictionally drive the ITM roller, causing the ITM to rotate, while the ITM in turn can frictionally drive the PIFM, causing the PIFM to rotate. It will be appreciated that with a frictional drive, the compliant character of the ITM will tend to cause the ITM to be underdriven by a relatively unyielding transport web (backed by a roller), and will also tend to cause the ITM to overdrive a relatively hard PIFM. In a machine including, for example, four successive modules, it will be further appreciated that the amounts of overdrive (or underdrive) in each module will tend to differ to some degree, inasmuch as there may be slightly different engagements between members or slightly different roller dimensions in the individual modules, e.g., arising from tolerance errors or ambient temperature differences. These differences in module-to-module amounts of overdrive (or underdrive) can cause significant color shifts and other registration errors between transferred single color toner images overlaid on a receiver sheet. On the other hand, the use of a compliant ITM roller having a stiffening layer according to the invention dramatically improves upon the prior art by dramatically reducing absolute amounts of overdrive (or underdrive) and also by reducing overdrive sensitivity to tolerancing errors and ambient fluctuations.

Figure 8:
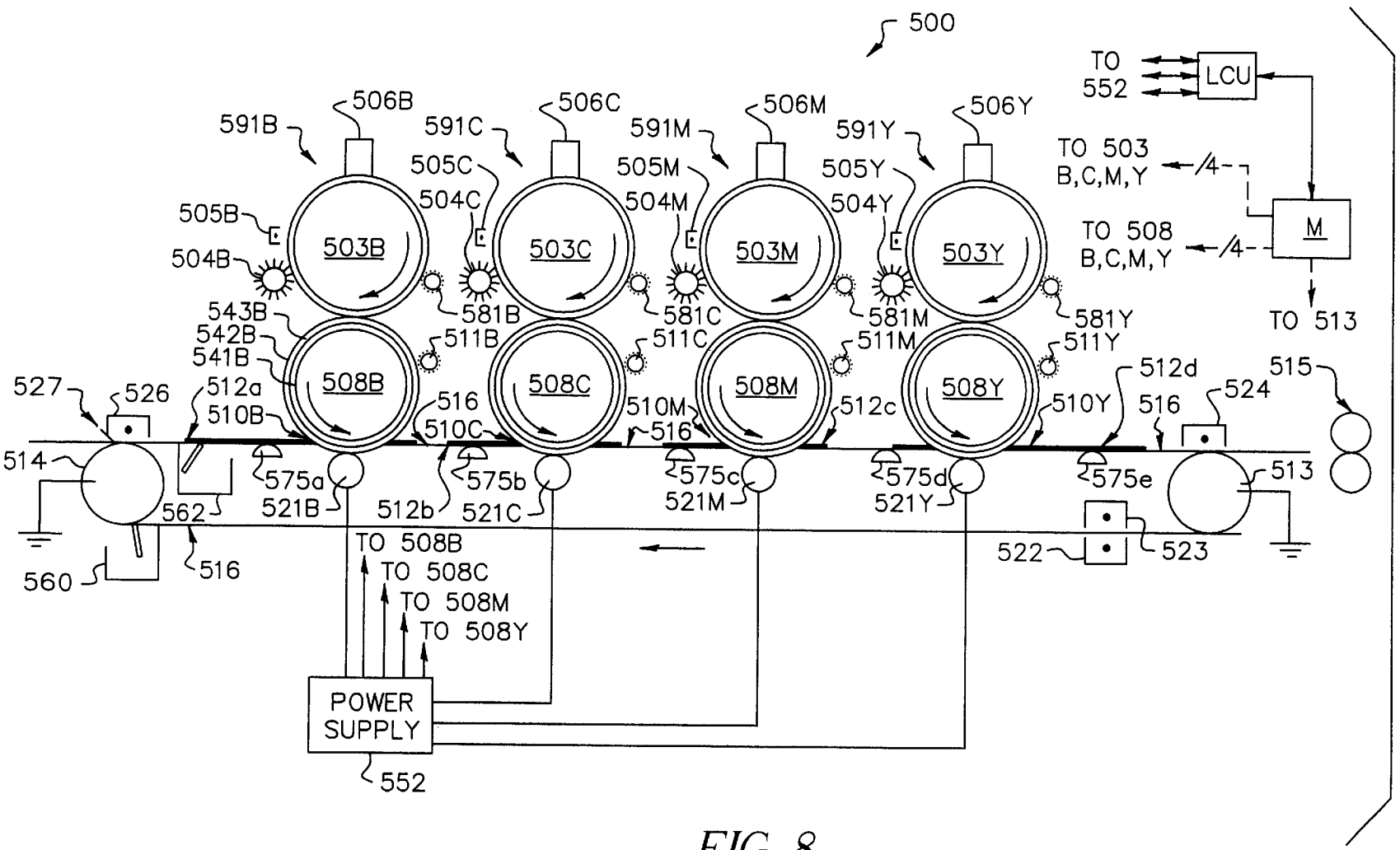
FIG. 8 is a generally schematic side elevational view of an imaging apparatus utilizing four modules, each module comprising a photoconductive primary image-forming member from which a single color toner image is electrostatically transferred to an ITM roller including a stiffening layer, with an endless web and web-driving mechanism for facilitating electrostatic transfer of the single color toner image from the ITM roller to a receiver member adhered to and carried by the endless web through each of the four modules, only basic components being shown for clarity of illustration.

Referring now to the accompanying drawings, FIG. 8 shows an electrostatographic imaging apparatus according to a preferred embodiment of the invention. The imaging apparatus, designated generally by the numeral 500, is in the form of an electrophotographic imaging apparatus and more particularly a color imaging apparatus wherein color separation images are formed in each of four color modules and transferred in register to a receiver member as a receiver member is moved through the apparatus while supported on a paper transport web (PTW) 516. An example of a PTW is described in U.S. Pat. No. 6,016,415, in the names of Herrick et al and in the aforementioned U.S. Pat. No. 6,075,965. The apparatus features four color modules although this invention is applicable to one or more such modules.

Each module (591B, 591C, 591M, 591Y) is of similar construction except that as shown one paper transport web 516 which may be in the form of an endless belt operates with all the modules and the receiver member is transported by the PTW 516 from module to module. The elements in FIG. 8 that are similar from module to module have similar reference numerals with a suffix of B, C, M, and Y referring to the color module to which it is associated; i.e., black, cyan, magenta and yellow, respectively. Four receiver members or sheets 512A, 512B, 512C, and 512D are shown simultaneously receiving images from the different modules, it being understood as noted above that each receiver member may receive one color image from each module and that in this example up to four color images can be received by each receiver member. The movement of the receiver member with the PTW 516 is such that each color image transferred to the receiver member at the transfer nip of each module is a transfer that is registered with the previous color transfer so that a four-color image formed on the receiver member has the colors in registered superposed relationship on the receiver member. The receiver members are then serially detacked from the PTW and sent to a fusing station 515 to fuse the dry toner images to the receiver member. The PTW is reconditioned for reuse by providing charge to both surfaces using, for example, opposed corona chargers 522, 523 which neutralize charge on the two surfaces of the PTW.

Each color module includes a primary image-forming member (PIFM), for example a rotating drum labeled 503B, 503C, 503M, and 503Y, respectively. The drums rotate about their respective axes in the directions shown by the arrows. Each PIFM 503B, 503C, 503M and 503Y has a photoconductive surface, upon which a pigmented marking particle image, or a series of different color marking particle images, is formed. In order to form images, the outer surface of the PIFM is uniformly charged by a primary charger such as a corona charging device 505B, 505C, 505M, and 505Y, respectively or other suitable charger such as roller chargers, brush chargers, etc. The uniformly charged surface is exposed by suitable exposure means, such as for example a laser 506B, 506C, 506M, and 506Y, respectively or more preferably an LED or other electro-optical exposure device or even an optical exposure device to selectively alter the charge on the surface of the PIFM to create an electrostatic latent image corresponding to an image to be reproduced. The electrostatic latent image is developed by application of pigmented marking particles to the latent image bearing photoconductive drum by a development station 581B, 581C, 581M, and 581Y, respectively. The development station is a particular color of pigmented toner marking particles associated respectively therewith. Thus, each module creates a series of different color marking particle images on the respective photoconductive drum. In lieu of a photoconductive drum, which is preferred, a photoconductive belt may be used.

It is well established that for high quality electrostatographic color imaging, small toner particles are necessary. It is preferred to use small toner particles having a mean volume weighted diameter of between 2 and 9 micrometers, as determined by a suitable commercial particle sizing device such as a Coulter Multisizer. More preferably, a toner particle diameter of between 6 and 8 micrometers is employed in the present invention. A widely practiced method of improving toner transfer is to use toner particles with addenda including sub-micron particles of silica, alumina, titania, and the like, attached or adhered to the surfaces of toner particles (so-called surface additives). In practice of the present invention, it is preferred to use a surface additive ncluding sub-micron hydrophobic fumed silica particles, but other formulations utilizing sub-micron particle surface additives may also be useful.

Each marking particle image formed on a respective PIFM is transferred in a transfer nip electrostatically to an outer surface of a respective secondary or intermediate image transfer member (ITM), for example, an intermediate transfer drum 508B, 508C, 508M, and 508Y, respectively. After transfer the toner image is cleaned from the surface of the photoconductive drum by a suitable cleaning device 504B, 504C, 504M, and 504Y, respectively to prepare the surface for reuse for forming subsequent toner images. The lengths of the PIFMs and ITM rollers described herein are generally longer than the widest receiver sheet to receive an image.

The intermediate transfer drum or ITM roller preferably includes a metallic (such as aluminum) conductive core member 541B, 541C, 541M, and 541Y, respectively and a compliant multilayer blanket 543B, 543C, 543M, and 543Y, respectively. A preferred core member is rigid and is generally not solid throughout, but preferably includes a hollow tube, and may have interior structures which may include chambers, strengthening struts, and the like. The compliant multi-layer blanket (detailed structure not shown in FIG. 8) includes one or more compliant layers and a stiffening layer. The stiffening layer has the form of an endless belt concentric with the one or more compliant layers, and is located preferably near, or in some cases at, the outer surface of the compliant multi-layer blanket. The primary function of the stiffening layer is to reduce variations in the surface strains produced by, for example, engagements with the IFMs in the first transfer step and with the receiver members in the second transfer step while maintaining the overall compliance of the roller. In the second transfer step it should be noted that the variations in the surface strains will also be reduced.

Each compliant layer of the multi-layer blanket 543B, 543C, 543M, and 543Y is formed of an elastomer such as a polyurethane or other materials well noted in the published literature. The elastomer has been doped with sufficient conductive material (such as antistatic particles, ionic conducting materials, or electrically conducting dopants) to have a relatively low resistivity (for example, a bulk or volume electrical resistivity preferably in the range of approximately $10^7$ to $10^{11}$ ohm-cm). The one or more compliant layers may differ compositionally from one another, or have differing physical properties. The stiffening layer rests on a compliant layer and may or may not have a compliant layer outside of it. When the multi-layer blanket 543B, 543C, 543M, and 543Y comprises an outer compliant layer, a thin overcoat release layer 542B, 542C, 542 M, and 542Y preferably covers the outer compliant layer. When the compliant multi-layer blanket (CMB) includes an outer stiffening layer, the thin overcoat release layer (RL) 542B, 542C, 542 M, and 542Y is optional and is provided when the stiffening layer does not have suitable release properties.

In a preferred embodiment, each CMB includes an inner compliant layer coated on the core 541B, 541C, 541M, and 541Y, a relatively thin stiffening layer in intimate contact with the inner compliant layer, and an outer compliant layer coated on the stiffening layer. Preferably, the stiffening layer (SL) includes a suitable metal, e.g., steel, and more preferably, nickel, and may further include a plating, such as for example a metal plating of copper, gold, or other suitable metallic plating. The SL may include an elastomer such as for example a polyurethane, a polyimide, a polyamide or a fluoropolymer. Further, the SL may include a sol-gel or a ceramer. Stiffening layers in general should have a yield strength which is not exceeded during operation of the ITM. The release layer preferably includes a sol-gel, a ceramer, a polyurethane or a fluoropolymer, but other materials having good release properties including low surface energy materials may also be used.

When the ITM roller includes a compliant multi-layer blanket having an outer stiffening layer and a release layer coated on the stiffening layer, the SL and the RL may belong to the same class of materials (e.g., a ceramer) having different compositional or physical characteristics such as for example yield strength, Young's modulus, thickness or electrical resistivity. The stiffening layer and the release layer (if present) generally have bulk or volume electrical resistivities that differ from one another and differ also from the resistivities of the one or more compliant layers, the resistivity of the release layer preferably being in a range $10^7$–$10^{13}$ ohm-cm.

Generally speaking, the compliance of a layer may be considered in terms of macro-compliance and micro-compliance. In macro-compliance, the layer is able to conform to relatively large features, e.g., to form a nip. Micro-compliance, on the other hand, comes into play at, for example, the scale of individual toner particles, paper roughness, or areas of thick toner coverage. A compliant layer is here defined as having a Young's modulus less than about 50 MPa, and a non-compliant layer as having a Young's modulus greater than about 50 MPa.

An electrical bias may be applied to an ITM roller 508B, 508C, 508M, and 508Y, respectively in order to effect electrostatic transfer of a toner image from a PIFM 503B, 503C, 503M, and 503Y, respectively. The electrical bias may be directly applied to the core member when it is metallic or conductive, or to a conductive coating, e.g., a metallic film, applied to the surface of the core member when it is non-conductive. Alternatively, it may be advantageous to apply the electrical bias to an electrically conductive stiffening layer.

Using an ITM roller according to the invention having a relatively conductive structure, transfer of the single color marking particle images from the PIFM roller to the surface of the ITM can be accomplished with a relatively narrow nip width (preferably 2–15 mm and more preferably 3–8 mm) and a relatively modest potential of, for example, 600 volts of suitable polarity applied by connecting a potential source (not shown) to the core member 541B, 541C, 541M, and 541Y, respectively, or connecting a potential source to the stiffening member of each ITM.

A single color marking particle image respectively formed on the surface 542B (others not identified) of each intermediate image transfer member drum, is transferred to a toner image receiving surface of a receiver member, which is fed into a nip between the intermediate image transfer member drum and a pressure transfer roller (PTR) 521B, 521C, 521M, and 521Y, respectively, that has an outer resistive blanket and is suitably electrically biased by power supply 552 to induce the charged toner particle image to electrostatically transfer to a receiver sheet. The receiver member is fed from a suitable receiver member supply (not shown) and is suitably "tacked" to the PTW 516 and moves serially into each of the nips 510B, 510C, 510M, and 510Y where it receives the respective marking particle image in suitably registered relationship to form a composite multicolor image. The transfer and the receiver sheet is under pressure and in the presence of and electric field urging transfer. Preferably, the transfer is not accomplished at an elevated temperature that would soften the toner. As is well known, the colored pigments can overlie one another to form areas of colors different from that of the pigments. The receiver member exits the last nip and is transported by a suitable transport mechanism (not shown) to a fuser where the marking particle image is fixed to the receiver member by application of heat and/or pressure and, preferably both. A detack charger 524 may be provided to deposit a neutralizing charge on the receiver member to facilitate separation of the receiver member from the belt 516. The receiver member with the fixed marking particle image is then transported to a remote location for operator retrieval or inverted and returned for formation of a duplex image on the reverse side. The respective ITMs are each cleaned by a respective cleaning device 511B, 511C, 511M, and 511Y to prepare it for reuse. Although the ITM is preferred to be a drum, a web may be used instead as an ITM.

Appropriate sensors (not shown) of any well known type, such as mechanical, electrical, or optical sensors for example, are utilized in the imaging apparatus 500 to provide control signals for the apparatus. Such sensors are located along the receiver member travel path between the receiver member supply through the various nips to the fuser. Further sensors may be associated with the primary image forming member photoconductive drum, the intermediate image transfer member drum, the transfer backing member, and various image processing stations. As such, the sensors detect the location of a receiver member in its travel path, and the position of the primary image forming member photoconductive drum in relation to the image forming processing stations, and respectively produce appropriate signals indicative thereof. Such signals are fed as input information to a logic and control unit LCU including a microprocessor, for example. Based on such signals and a suitable program for the microprocessor, the control unit LCU produces signals to control the timing operation of the various electrographic process stations for carrying out the imaging process and to control drive by motor M of the various drums and belts. The production of a program for a number of commercially available microprocessors, which are suitable for use with the invention, is a conventional skill well understood in the art. The particular details of any such program would, of course, depend on the architecture of the designated microprocessor.

Figure 9:
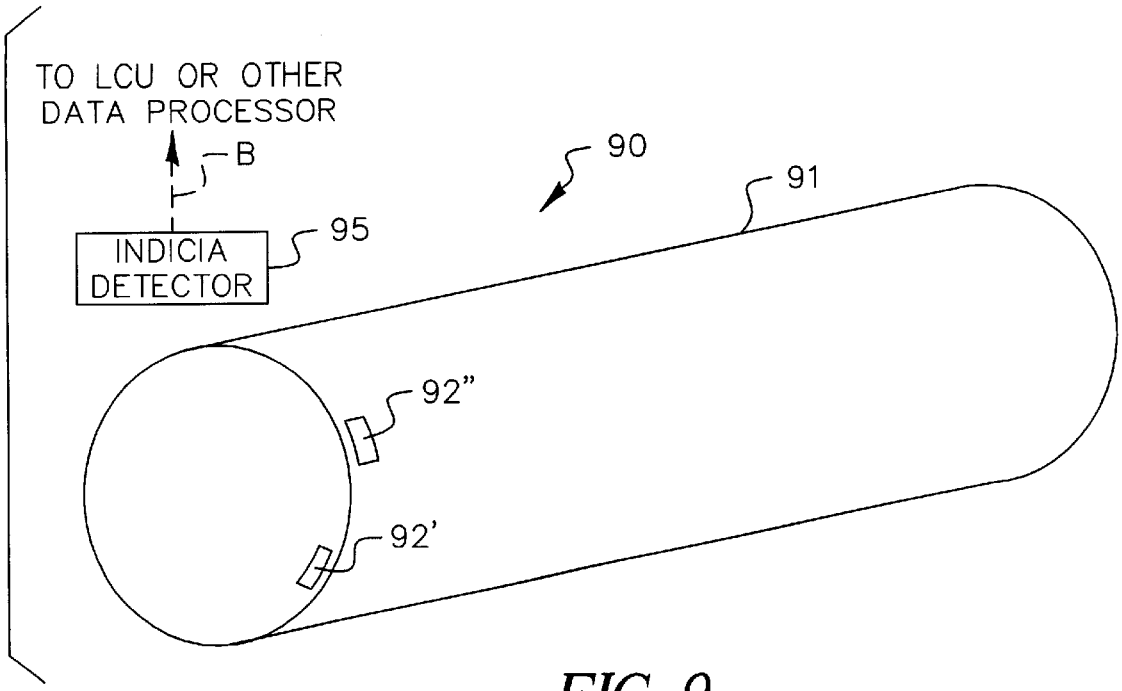
FIG. 9 is a sketch of an exterior portion of an inventive ITM roller having marked on it descriptive indicia located on the outer surface in a small area located close to an end of the sleeve member.
Figure 10:
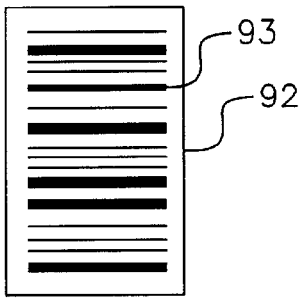
FIG. 10 is a diagrammatic illustration of a bar code type of indicia used on the ITM roller of FIG. 9.

FIG. 9 shows a sketch of an inventive ITM roller, indicated as 90, on which the outer surface 91 of the roller has marked on it a set of descriptive markings or indicia which are provided on the roller to indicate a parameter relative to the roller. Preferably, the indicia are located in a small area 92" located on a portion of the cylindrical surface close to an end of the roller and outside of an area used for transfer. More preferably, the indicia are contained in a small area 92' located on an end portion of roller 90 near the edge (the individual layers comprising roller 90 are not shown). An enlarged view 92 of either of the small areas 92' or 92" is shown in FIG. 10 and illustrates that the descriptive indicia may be in the form of a bar code, as indicated by the numeral 93, which may be read, for example, by a scanner. The scanner may be mounted in an electrophotographic machine so as to monitor an inventive ITM roller, e.g., during operation of the machine or during a time when the machine is idle, or the scanner may be externally provided during installation of, or maintenance of, an inventive roller. Generally, the indicia may be read, sensed or detected by an indicia detector 95. As indicated in FIG. 9 by the dashed arrow labeled B, the analog or digital output of the indicia detector may be sent to a logic control unit (LCU) incorporated in an electrostatographic machine utilizing an inventive ITM roller, or it may be processed externally, e.g., in a portable computer during the installation or servicing of an inventive ITM roller, or it may be processed in any other suitable data processor. The indicia may be read optically, magnetically, electrically, mechanically, or by means of radio frequency. In addition to a bar code 93, the indicia may comprise any suitable markings, including symbols and ordinary words, and may be color coded. The indicia may also be read visually or interpreted by eye. Suitable materials for the indicia are for example inks, paints, magnetic materials, reflective materials, and the like, which may be applied directly to the surface of the roller. The indicia maybe a memory device that stores a code and communicates with the detector electrically or elects optically. Alternatively, the indicia may be located on a label that is adhered to the outer surface of the roller. The indicia may also be in raised form or produced by stamping with a die or by otherwise deforming a small local area on the outer surface of the roller, and the deformations may be sensed mechanically or otherwise detected or read using an indicia detector 95 in the form of a contacting probe or by other mechanical means.

Different types of information may be encoded or recorded in the indicia. For example, the outside diameter of a roller may be recorded so that nip width or registration parameters can be accordingly adjusted. The effective resistivity of an ITM roller in a radial direction may be recorded in the indicia so that the electrical bias applied to the roller may be suitably adjusted for optimal performance. The effective hardness and effective Young's modulus of an inventive roller may be recorded in the indicia so that nip widths may be suitably adjusted. The date of manufacture of the roller may be recorded in the indicia for diagnostic purposes, so that the end of useful life of the roller could be estimated for timely replacement. Specific information for each given roller regarding the roller runout, e.g., as measured after manufacture, may also be recorded in the indicia, and this information could be used for optimizing registration, e.g., between modules. Moreover, the orientation of an inventive roller, such as for example a skew between an inventive roller and a primary imaging roller, may be described by the indicia.

When the outside diameter of the ITM roller is recorded in the indicia, the information may be used to speed the calibration time of a registration system as explained below. For example, the registration system may utilize a software algorithm that controls the speed of the start-of-line clock signal fed to an LED writehead. A separate start-of-line clock signal is used for each color module, each controlling the length of the color toner image of the respective color separation image produced by each module, thereby ensuring that the color toner image length is correct and uniform throughout the image. It is known that, in general, a change in the engagement between a primary imaging roller and an ITM roller changes the speed ratio, thereby altering the length of the image, e.g., by stretching or compressing it as the engagement is increased or decreased. ITM rollers cannot be manufactured practically with identical outside diameters, a typical variation being ±50 micrometers. A small difference in the diameter of a newly installed ITM roller will, therefore, effectively change the engagement between the primary imaging and ITM rollers. By utilizing the diameter information of a newly installed roller, the registration unit can immediately correct the start-of-line clock signal so that the image length and uniformity is maintained correctly. This adjustment of the parameters in the algorithm controlling the start-of-line clock signal is one of several parameters that need to be controlled to ensure accurate registration of each digital image written by the writehead. Prior knowledge of the outside diameter given in the bar code speeds the calibration time of the registration system.

The indicia may also provide runout information relative to the ITM roller. The ITM roller radius may, and usually is, different at different points along the periphery. Similarly, the PIFR will also have radius variations both known as runout, as described above. It is desirable to mount the ITM so that the ITM, when engaged with the PIFR, won't have respective maximum radial peaks that periodically engage. The indicia, or the position of the indicia on the sleeve, may represent a relative mounting of the ITM roller about its rotation axis relative to the PIFR it is to be engaged with.

The receiver members utilized with the reproduction apparatus 500 can vary substantially. For example, they can be thin or thick paper stock or transparency stock. As the thickness and/or resistivity of the receiver member stock varies, the resulting change in impedance affects the electric field used in the nips 510B, 510C, 510M, 510Y to urge transfer of the marking particles to the receiver members. Moreover, a variation in relative humidity will vary the conductivity of a paper receiver member, which also affects the impedance and hence changes the transfer field. To overcome these problems, the paper transport belt preferably includes certain characteristics.

The endless belt or web (PTW) 516 is preferably comprised of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multi-layer article.

The web material may be of any of a variety of flexible materials such as a fluorinated copolymer (such as polyvinylidene fluoride), polycarbonate, polyurethane, polyethylene terephthalate, polyimides (such as Kapton™), polyethylene napthoate, or silicone rubber. Whichever material that is used, such web material may contain an additive, such as an anti-stat (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the PTW once the receiver member has been removed. The PTW may have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt is relatively thin (20 micrometers–1000 micrometers, preferably, 50 micrometers–200 micrometers) and is flexible. It is also envisioned that the invention applies to an electrostatographic color machine wherein a generally continuous paper web receiver is utilized and the need for a separate paper transport web is not required. Such continuous webs are usually supplied from a roll of paper that is supported to allow unwinding of the paper from the roll as the paper passes as a generally continuous sheet through the apparatus.

In feeding a receiver member onto belt 516 charge may be provided on the receiver member by charger 526 to electrostatically attract the receiver member and "tack" it to the belt 516. A blade 527 associated with the charger 526 may be provided to press the receiver member onto the belt and remove any air entrained between the receiver member and the belt.

A receiver member may be engaged at times in more than one image transfer nip and preferably is not in the fuser nip and an image transfer nip simultaneously. The path of the receiver member for serially receiving in transfer the various different color images is generally straight facilitating use with receiver members of different thicknesses.

The endless paper transport web (PTW) 516 is entrained about a plurality of support members. For example, as shown in FIG. 8, the plurality of support members are rollers 513, 514 with preferably 513 being driven as shown by motor M (of course, other support members such as skis or bars would be suitable for use with this invention). Drive to the PTW can frictionally drive the ITM rollers to rotate the ITMs which in turn causes the PIFM rollers to be rotated, or additional drives may be provided. The process speed is determined by the speed of the PTW which is typically 300 mm $sec^{-1}$. A PIFM may be slightly skewed relative to an ITM. In this regard, reference is made to U.S. patent application Ser. No. 09/457,455, filed in the name of Tombs et al, the contents of which are incorporated herein by reference.

Support structures 575A, 575B, 575C, 575D, and 575E are provided before entrance and after exit locations of each transfer nip to engage the belt on the backside and alter the straight line path of the belt to provide for wrap of the belt about each respective ITM roller so that there is wrap of the belt of greater than 1 mm on each side of the nip (pre-nip and post-nip wraps) or at least one side of the nip and preferably the total wrap is less than 20 mm. The nip is where the pressure roller contacts the backside of the belt or where no pressure roller is used, where the electrical field is substantially applied. However, the image transfer region of the nip is a smaller region than the total wrap. The wrap of the belt about the ITM roller also provides a path for the lead edge of the receiver member to follow the curvature of the ITM but separate from engagement with the ITM while moving along a line substantially tangential to the surface of the cylindrical ITM. Pressure applied by the pressure transfer rollers (PTRs) 521B, 521C, 521M, and 521Y is upon the backside of the belt 516 and forces the surface of the compliant ITM to conform to the contour of the receiver member during transfer. Preferably, the pressure of each PTR 521B, 521C, 521M, and 521Y on the PTW 516 is 7 pounds per square inch or more. The PTRs may be replaced by corona chargers, biased blades or biased brushes. Substantial pressure (preferably without presence of elevated temperature that would soften the toner) is provided in the transfer nip to realize the benefits of the compliant intermediate transfer member which are conformation of the toned image to the receiver member and image content. The pressure may be supplied solely by the transfer biasing mechanism or additional pressure applied by another member such as a roller, shoe, blade or brush. The ITM roller is also in pressure engagement with the PIFR to transfer the toner image on the PIFR to the ITM. The references disclose the use of air cylinders which urge the PIFR and ITR together into a nip. Springs may also be used either alone or in combination with air cylinders.

It is to be understood in FIG. 8 that the amount of pre-nip wrap and post-nip wrap may be set to any convenient values in any of the modules, and may be made to differ module to module by adjustments of the individual elevations of individual support structures or by placing the support structures at points that are not half-way between modules, or both. Moreover, in order to have independent control of the amounts of pre-nip and post-nip wrap within each module, a larger number of support structures may be used, e.g., two support structures per module, one on each side of each transfer nip. Support structures may include skids, bars, rollers, and the like.

Figure 1:
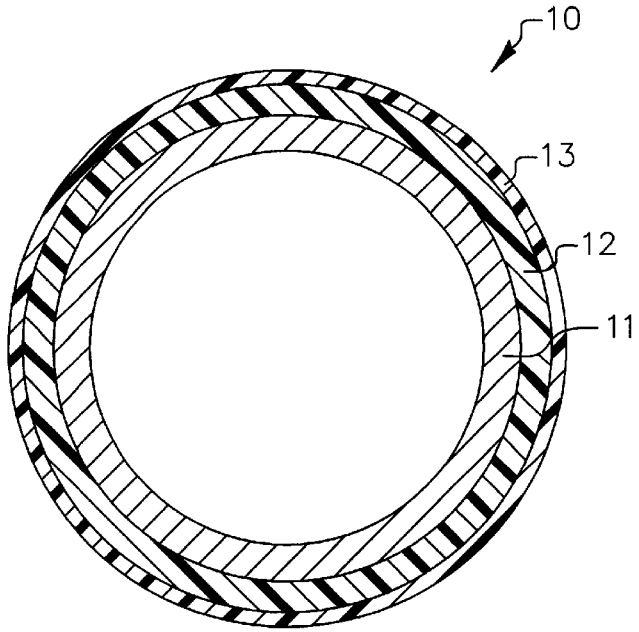
FIG. 1 is a cross-sectional view of an ITM roller according to a first embodiment of the invention showing an outer portion of a core member covered by a compliant layer covered by a stiffening layer.

Turning to a fuller description of the preferred ITM roller embodiments of the invention, FIG. 1 shows a cross-sectional view of a first ITM roller embodiment indicated by the numeral 10, including a core member 11, a compliant layer 12 formed on and covering the core member, and a stiffening layer 13 in intimate contact with and outside of the compliant layer. The compliant layer 12 has a thickness in a range of 2–20 mm, and a Young's modulus in a range of 0.1 to 10 MPa and preferably in a range of 1–5 MPa. The compliant layer has a resistivity in a range of $10^7$–$10^{11}$ ohm-cm and preferably about $1\times10^9$ ohm-cm. Preferably, the compliant layer 12 is a non-foamed elastomer and preferably incompressible so that the volume is constant as the ITM roller deforms in each of the toner image transfer nips. The compliant layer has a Poisson's ratio of 0.2–0.5 and more preferably 0.45 to 0.5. The stiffening layer (SL) 13 has the form of a preferably seamless endless belt, having a suitable thickness in a range of greater than 50 and up to 1,000 micrometers with a constraint (in this and other embodiments described herein) that a suitable thickness is thick enough to have a yield strength which is not exceeded during operation of the ITM roller, i.e., the stiffening layer remains as a continuous belt and does not crack or break up into platelets. Generally, for a stiffening layer having a Young's modulus of 100–300 GPa the thickness of the stiffening layer should be in the range of greater than 50 micrometers and up to 1,000 micrometers. For a stiffening layer having a Young's modulus of 0.1 to less than 100 GPa the thickness of the stiffening layer should be thicker and in the range 100–1,000 micrometers.

The stiffening layer 13 may include a sheet wrapped around the inner compliant layer and smoothly joined by a seam to create an endless belt, but is preferably a continuous band without a seam. The stiffening layer has a resistivity in a range of $10^7$–$10^{11}$ ohm-cm and preferably about $10^9$ ohm-cm. The stiffening layer has a Young's modulus in a range of 0.1–300 GPa, preferably in a range of 0.5–200 GPa. Preferably, the stiffening layer has suitable surface release properties. The presence of the stiffening layer, with it's high hoop stiffness, effectively hinders significant alteration of the circumference of the ITM 10 when it is compliantly distorted in a pressure nip during transfer of a toner image from a primary imaging member to the ITM or during transfer of a toner image from the ITM to a receiver member. As a result, any tendency towards creating overdrive (or underdrive) is greatly diminished as compared to an otherwise similar roller lacking the stiffening member, while the compliance for the nip is maintained due to the low bending stiffness of the stiffening layer.

Figure 2:
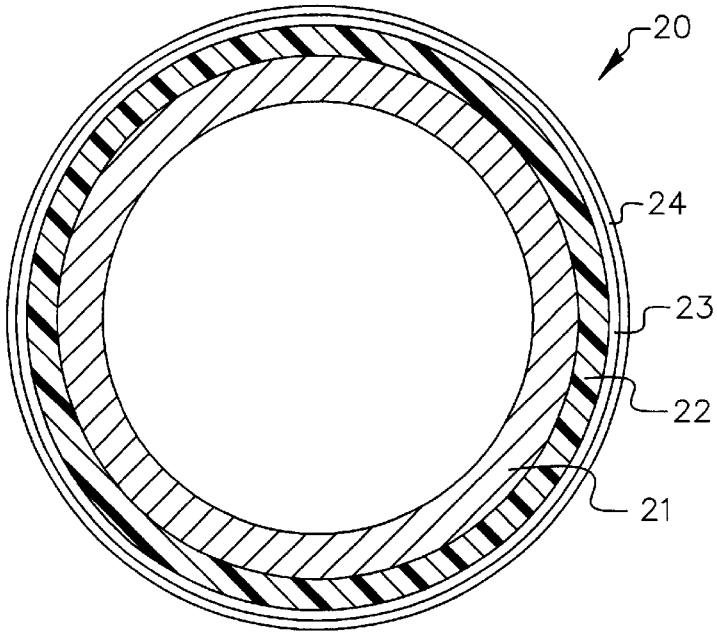
FIG. 2 is a cross-sectional view of an ITM roller according to a second embodiment of the invention showing an outer portion of a core member covered by a compliant layer covered by a stiffening layer, the stiffening layer covered by a thin release layer.

FIG. 2 shows a cross-sectional view of a second ITM roller embodiment designated by the numeral 20, including a core member 21, a compliant layer 22 formed on and covering the core member, a stiffening layer 23 in intimate contact with and outside of the compliant layer, and a thin release layer 24 coated on the stiffening layer. The compliant layer 22 has a thickness in a range of 2–20 mm, and a Young's modulus which is in the range of 0.1 to 10 MPa and preferably in a range of 1–5 MPa. The compliant layer has a resistivity in a range of $10^7$–$10^{11}$ ohm-cm and preferably about $1\times10^9$ ohm-cm. Preferably, the compliant layer 22 is a non-foamed elastomer and preferably incompressible as that the volume is constant as the ITM roller defoams in each of the toner image transfer nips. The compliant layer has a Poisson's ratio in the range of 0.2–0.5 and preferably 0.45–0.5. The stiffening layer 23 has the form of a preferably seamless endless belt having a thickness in a range of 50–1,000 micrometers. The stiffening layer may include a sheet wrapped around the compliant layer and smoothly joined by a seam to create an endless belt. The preferred form of the stiffening layer is a continuous band without a seam so that the image transfer capability is not affected by a seam. The stiffening layer has a resistivity in a range of $10^7$–$10^{11}$ ohm-cm and preferably about $10^9$ ohm-cm. The stiffening layer has a Young's modulus in a range of 0.1–300 GPa, preferably in a range of 0.5–200 GPa. The release layer has a thickness in a range of 1–50 micrometers and preferably in a range of 4–15 micrometers. The release layer has a resistivity in a range of $10^7$–$10^{13}$ ohm-cm and preferably about $10^{10}$ ohm-cm, and a Young's modulus greater than 100 MPa. As noted above for the first embodiment a stiffening layer having a Young's modulus in the range of 100–300 GPa may be thinner than a stiffening layer which was a Young's modulus less than 100 Gpa.

The embodiment of FIG. 2 is generally preferred over that of FIG. 1 when the stiffening layer does not provide suitable surface release properties. The performance of the embodiment of FIG. 2 in reducing a tendency for overdrive (or underdrive) will generally closely match the performance of the embodiment of FIG. 1.

Figure 3:
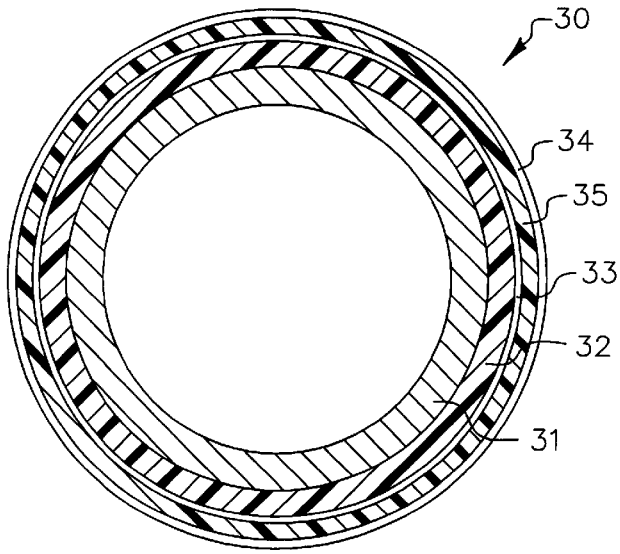
FIG. 3 is a cross-sectional view of an ITM roller according to a third embodiment of the invention showing an outer portion of a core member covered by an inner compliant layer covered by a stiffening layer, the stiffening layer covered by an outer compliant layer, the outer compliant layer covered by a thin release layer.

A third preferred ITM roller embodiment is illustrated in FIG. 3 and is designated in a cross-sectional view by the numeral 30. This preferred embodiment includes a core member 31, an inner blanket layer or inner compliant layer 32 formed on and covering the core member, a stiffening layer 33 in intimate contact with and outside of the inner compliant layer, an outer blanket layer or outer compliant layer 35 formed on and covering the stiffening layer, and a thin release layer 34 coated on the outer compliant layer. The inner compliant layer has a Young's modulus in a range of 0.1–10 MPa and preferably in a range of 1–5 MPa. The inner compliant layer 32 has a Poisson's ratio in a range of 0.2–0.5, preferably 0.45–0.5, and may be a foamed or non-foamed elastomer, preferably a non-foamed elastomer, that is preferably incompressible so that the volume is constant as the ITM roller deforms in each of the toner image transfer nips. The inner compliant layer has a thickness in a range of 2–20 mm, and a resistivity preferably in a range of $10^7$–$10^{11}$ ohm-cm and preferably about $10^9$ ohm-cm. The stiffening layer 33 has the form of a preferably seamless endless belt. The stiffening layer may include a sheet wrapped around the inner compliant layer and smoothly joined by a seam to create an endless belt, but an unseamed continuous band is preferred. The stiffening layer has a thickness in a range 10–300 micrometers and a resistivity less than about $10^{10}$ ohm-cm, preferably less than $10^5$ ohm-cm. The stiffening layer has a Young's modulus greater than 0.1 GPa and preferably in a range of 50–300 GPa. As dependent on suitability or convenience, either the core member 31 or the stiffening layer 33 may be connected to a source of voltage or current in order to provide electrostatic transfer of a toner image from a primary image-forming member to the ITM 30. However, if the SL is electrically biased then it's resistivity is preferably less than $10^5$ ohm-cm and the resistivity of the inner layer becomes unimportant and can be specified outside the above mentioned range. The outer compliant layer has a Young's modulus in a range of 0.1 to 10 MPa and preferably in a range of 1–5 MPa. A ratio of the thickness of the outer compliant layer 35 divided by the thickness of the inner compliant layer 32 is preferably less than 1.0, and more preferably, less than about 0.3. The outer compliant layer has thickness in a range of 0.5–4 mm, and a resistivity in a range of $10^7$–$10^{11}$ ohm-cm and preferably about $10^9$ ohm-cm. The outer compliant layer is also preferably a non-foamed elastomer that is incompressible and has Poisson ratio in the ranges recited for the inner compliant layer. The release layer 34 has a Young's modulus greater than 100 MPa, and a thickness in a range of 1–50 micrometers and preferably in a range of 4–15 micrometers. The release layer has a resistivity in a range of $10^7$–$10^{13}$ ohm-cm and preferably about $10^{10}$ ohm-cm.

The third ITM roller embodiment of FIG. 3 is preferred because the inner compliant layer 32 provides macro-compliance and the outer compliant layer 35 provides micro-compliance. As a result of the fact that the macro-compliance and the micro-compliance are decoupled by the intervening stiffening layer, it is possible and advantageous to tailor the macro-compliance and the micro-compliance independently, e.g., by providing differing chemical compositions or differing physical properties to the inner and outer compliant layers. Moreover, the presence of the stiffening layer provides a very low tendency towards overdrive (or underdrive).

The preferred mode of the third embodiment is now described with reference to FIG. 3. The core member 31 is an aluminum drum having an outer diameter of 154.00 mm±0.06 mm, with a runout of less than 20 micrometers, and a length of 360.0 mm±0.3 mm. The inner compliant layer 32 formed on core member 31 includes a polyurethane doped by an anti-stat as described below, and has an outer diameter of 170.00 mm±0.05 mm with a runout of less than 20 micrometers. The inner compliant layer 32 has a surface roughness $R_A$<0.5 micrometers and a surface roughness $R_Z$<3 micrometers, as measured by a Mitatoya micro-profilometer using the method of ANSI B46.1 with a 0.25 mm cutoff. The inner compliant layer 32 has a Young's modulus of 3.5 MPa±1.0 MPa measured by the method of ASTM D575, and a hardness of 60±5 ShoreA. The stiffening layer (SL) 33 of the roller 30 is a seamless tube made of nickel. SL 33 has a thickness of 100 micrometers±5 micrometers, an inner surface roughness $R_Z$<2 micrometers as measured by a Mitatoya micro-profilometer using the method of ANSI B46.1 with a 0.25 mm cutoff, a Young's modulus of 210 GPa±10 GPa measured by the method of ASTM D412, an inner diameter of 169.70 mm±0.01 mm when unstretched (i.e., having a tensile strain of zero), and a length of 360.0 mm±0.3 mm. The SL is connected to a source of voltage or current to provide a suitable electric field for the transfers of a toner image, from a primary image forming member to the inventive roller, and from the inventive roller to a receiver sheet. Prior to forming the outer compliant layer 35 on the SL 33, the surface of the SL was prepared according to the method of Example 1 below. The outer compliant blanket layer 35 formed on SL 33 comprises a polyurethane doped with an anti-stat and was formed on the SL by the method of Example 2 below. The outer compliant blanket layer has a surface roughnesses $R_A$<0.5 micrometers and $R_Z$<3 micrometers as measured by a Mitatoya micro-profilometer using the method of ANSI B46.1 with a 0.25 mm cutoff, a Young's modulus of 3.5 MPa±1.0 MPa measured by the method of ASTM D575, a hardness of 60±5 ShoreA, a bulk resistivity measured at 70° F. and 35% relative humidity of $1.0\times10^9$ ohm-cm±$0.5\times10^8$ ohm-cm, an outer diameter of 174.00 mm±0.05, a runout<20, the outer compliant layer 35 having a length no longer than that of the SL 33. The outer release layer 34 coated on the blanket layer 35 is comprised of a ceramer, such as described in Ezeyilimba et al., U.S. Pat. No. 5,968,658, and has a thickness of 4 micrometers±1 micrometers, with a surface roughness $R_A$<0.5 micrometers and a surface roughness $R_z$<3 micrometers, as measured by a Mitatoya micro-profilometer using the method of ANSI B46.1 with a 0.25 mm cutoff. Release layer 34 has a Young's modulus of 1.1 GPa±0.4 GPa measured by the method of ASTM D882, and a bulk resistivity between $1\times10^{10}$ ohm-cm and $2\times10^{12}$ ohm-cm. The above-described roller produced acceptable images on a receiver after 250,000 rotations of the roller in a full-process electrophotographic machine.

Methods of making an inventive ITM roller according to the third embodiment are described below in sections (I), (II), (III) and (IV). Briefly, a core member is first coated with an inner compliant layer coating, and is then cooled to a lower temperature, e.g., using dry ice, in order to reduce its outer diameter. This is followed by mounting a sleeve on the cooled core plus inner compliant layer, the sleeve preferably including: a seamless tubular belt made of, e.g., nickel, an outer compliant layer coated on the seamless tubular belt, and a release layer coated on the outer compliant layer. After the assembly is allowed to warm up to ambient temperature, the sleeve snugly grips the inner compliant layer. Alternatively, this sleeve may include only the seamless tubular belt and the outer compliant layer, with the release layer being subsequently formed on the outer compliant layer after the sleeve is in place on the inner compliant layer. As another alternative, a seamless tubular belt made of, e.g., nickel, may first be mounted on the inner compliant layer, followed by successively applying the outer compliant layer and the release layer. In these alternative methods, the inner diameter of the sleeve is preferably chosen to be smaller than that of the outer diameter of the inner compliant layer prior to mounting the sleeve. Typically, the difference between these two diameters is between 100 and 300 micrometers, although a difference outside this range may also be useful. It may also be useful in some applications to provide an adhesive between the inner compliant layer and the seamless tubular belt. However, the stretching of the seamless tubular belt when applied to an inner compliant layer having an outer diameter greater than the inner diameter of the seamless tubular belt typically produces enough of an inward radial force to provide a strong enough grip between the seamless tubular belt and the inner compliant layer, making the sleeve substantially immovable during operation of the roller.

(I) Inner Compliant Layer Preparation on Core Member:

A prior art ITM roller including an aluminum drum core member coated by a compliant layer and an outer release layer, made as disclosed in U.S. Pat. No. 4,729,925 or in U.S. Pat. No. 5,212,032, may be used as a starting point. The prior art roller is ground to remove the release layer. Following this, the compliant layer is ground down to a predetermined thickness on the core, e.g., to form core 31 covered by inner compliant layer 32. Alternatively, an inner compliant layer 32 of the same predetermined thickness may be formed on an aluminum core 31 by the methods described in U.S. Pat. Nos. 4,729,925 and 5,212,032.

(II) Selection and Preparation of a Stiffening Layer Prior to Coating of a Blanket Layer:

Adhesion between the stiffening layer 33 and the outer blanket layer 35 is critical for the manufacture of a sleeve, which involves a harsh grinding process. Good adhesion also ensures that a sleeve can be ground to a finish with state-of-art equipment to give a very low run-out. Enhancement of the adhesion to a nickel stiffening layer can be done by cleaning the nickel surface well, e.g., by degreasing the nickel by a ketone solvent, or by etching it with a diluted strong acid or base. Roughening the surface may also help in promoting good adhesion. Another method to enhance adhesion is to use for the stiffening layer an electroformed copper plated nickel belt, e.g., purchased from Stork Screens America, Inc., of Charlotte, N.C. In addition to copper, metals such as aluminum or zinc can also be used to cover the nickel surface to enhance adhesion. Alternatively, adhesion can be greatly improved by surface treatment of the nickel belt to induce chemical bonding between nickel and polyurethane, such as by the use of commercially available urethane primers. Examples of such primers are CONAP® AD6, CONAP® AD1147 obtainable from Conap Inc. of Olean, N.Y., and Chemlok® 210, Chemlok® 213, Chemlok® 218, or Chemlok® 219 obtainable from Lord Corporation, Cary, N.C., to name just a few. However, such primers present an extra layer (primer layer) between nickel and conductive polyurethane blanket may contaminate and change the resistivity of the ITM. The preferred method is to surface treat the nickel belt as in the following example:

EXAMPLE 1

Surface Treatment of Nickel Sleeve Before Outer Compliant Layer Polyurethane Casting Preclean an electroformed nickel belt purchased from Stork Screens America, Inc., of Charlotte, N.C. with 1N sodium hydroxide solution, followed by rinsing with water, then air dry. Prepare treatment solution: 2 wt % (3-aminopropyltriethoxysilane obtained from Gelest Inc., of Tullytown, Pa.) and 98 wt. % (95% ethanol+5% water). Shelf life of the treatment solution is one hour. Dip cleaned nickel belt in treatment solution for 10 minutes. Rinse the nickel belt with ethanol. Cure sleeve at 150° C. for 30 minutes.

(III) Outer Compliant Layer Formulation and Preparation:

A polyurethane blanket is formed on a stiffening layer in a mold by casting from commercially available prepolymers, polyols, chain extenders and anti-stats. U.S. Pat. Nos. 4,729,925 and 5,212,032 teach preparation of resistive polyurethane elastomers based on bis [oxydiethylenebis(polycaprolactone)yl]5-sulfo-1,3-benzenedicarboxylate. In U.S. Pat. No. 4,729,925, a controlled resistivity is provided by including the anti-stat agent methyltriphenylphosphonium sulfate, known by the acronym PIP. In U.S. Pat. No. 5,212,032, a controlled resistivity is provided by including the anti-stat made from a complex of diethylene glycol and ferric chloride, abbreviated below as DGFC. Preferred procedures are given in Examples 2, 3 and 4 below.

EXAMPLE 2

Polyurethane Blanket Formulation with PIP anti-stat.

Mix together 55.385 grams of PIP anti-stat, 597.58 grams of PPG2000 diol-terminated prepolymer obtained from Dow Chemical Company of Midland, Mich., and 3 drops SAG 47 antifoam agent obtained from Witco Corporation of Greenwich, Conn. Add 2820.66 grams preheated L42 diisocyanate-terminated prepolymer obtained from Uniroyal Chemical Company of Middlebury, Conn., and 126.38 grams EC300 diamine obtained from Albemarle Corporation of Baton Rouge, La. (no heat). Optionally, add if necessary three drops of dibutyltin dilaurate (obtained from Aldrich Chemical Company of Milwaukee, Wis.). Mix well quickly and degas the mixture for five minutes. Pour the mixture into a mold containing a pre-treated stiffening layer as described above, and cure at 80° C. for 18 hours.

EXAMPLE 3

Polyurethane Blanket Formulation with DGFC anti-stat.

Mix together 0.364 grams DGFC anti-stat, 52.83 grams PPG2000 diol-terminated prepolymer obtained from Dow Chemical Company of Midland, Mich., and 3 drops SAG 47 antifoam agent obtained from Witco Corporation of Greenwich, Conn. Add 52.83 grams preheated L42 diisocyanate-terminated prepolymer obtained from Uniroyal Chemical Company of Middlebury, Conn., and 11.19 grams EC300 diamine obtained from Albemarle Corporation of Baton Rouge, La. (no heat). Optionally, add three drops if necessary of dibutyltin dilaurate (obtained from Aldrich Chemical Company of Milwaukee, Wis.). Mix well quickly and degas the mixture for five minutes. Pour the mixture into a mold containing a pre-treated stiffening layer as described above, and cure at 80° C. for 18 hours.

EXAMPLE 4

Polyurethane Blanket Formulation with PIP anti-stat.

Heat VB635 diisocyanate-terminated prepolymer, obtained from Uniroyal Chemical Company of Middlebury, Conn., at 100° C. for two hours before use. Dry at 100° C. under vacuum T-1000 diol-terminated prepolymer obtained from Chemcentral Corporation of Buffalo, N.Y. for two hours before use. Weigh and mix according to the following order: 41.25 grams PIP anti-stat, 1330.44 grams T1000, 1865.12 grams VB635, 63.185 grams TP-30 polyol from Perstorp Polyols Inc. of Toledo, Ohio, 17 drops of DABCO polymerization catalyst obtained from Aldrich Chemical Company of Milwaukee, Wis. Mix extremely well and degas for 5–8 minutes. Pour the degassed mixture into a sleeve mold. Place the mold into a preheated 100° C. oven and cure at 100° C. for 16 hours.

(IV) Release Layer:

U.S. Pat. No. 5,968,656 teaches the art of ceramer release overcoat composition and coating. The preferred coating method for the inventive ITM is ring-coating. Alternatively, spray coating, dip coating and transfer coating are also valid methods. Before any coating procedure, the coating solution may be heated or diluted with co-solvent. A concentration to suitably control thickness, uniformity, drying and curing depends on the coating method chosen. Co-solvents include alcohol, acetate, ketones, and the like.

In the following examples, embodiments of inventive ITM rollers are described.

EXAMPLE 5

Prototype 1 of an ITM Roller Embodiment

An inner compliant blanket layer of a polyurethane was cast on to a cylindrical aluminum core member in a mold, then cured and ground to a thickness of 4.72 mm. The inner compliant layer was then wrapped with a stiffening layer made of steel shimstock sheet 102 micrometers thick and butted up to make a seam, and an adhesive was used to bond the two layers together. An outer compliant blanket layer, about 1 mm thick and composed of a polyurethane doped with an anti-static compound to make its resistivity $1\times10^9$ ohm-cm, was cast in the form of a tube in a centrifugal caster and then cured. The tube was then placed on a mandrel and without grinding was ring-coated with a 6 micrometers thick layer of a ceramer release layer, after which the ceramer was cured. The tube was then removed from the mandrel and pulled on to the stiffening layer, using a compressed air assist technique to elastically stretch the tube slightly during the pulling-on operation. After the tube was satisfactorily placed in a suitable position on the stiffening layer, and the compressed air turned off, the tube gripped the stiffening layer snugly, thus forming a completed roller. The roller was then tested as an intermediate transfer member in an electrophotographic machine, using the stiffening layer to apply transfer voltage, and was found to perform satisfactorily.

EXAMPLE 6

Prototype 2 of an ITM Roller Embodiment

An inner compliant blanket layer of a polyurethane was cast on to a cylindrical aluminum core member in a mold, then cured and ground to a thickness of 4.72 mm. Molten zinc metal was spray-coated on to the inner compliant blanket to produce a zinc stiffening layer 90±10 micrometers thick. An outer compliant polyurethane layer doped with an anti-static compound and having a resistivity of $1\times10^9$ ohm-cm was then cast on top of the zinc in a mold, cured, ground to 1 mm thickness and then ring coated with a 6 micrometers thick layer of a ceramer. The ceramer was then cured to create a finished roller. The roller was subsequently tested as an intermediate transfer member in an electrophotographic machine, using the stiffening layer to apply transfer voltage. The roller was found to perform satisfactorily in making images on receiver sheets. However, it did not exhibit a relatively long life because the zinc layer cracked after extended operation. When the roller was new, its overdrive behavior was tested in a test apparatus in which a relatively rigid primary imaging roller was used to frictionally drive the prototype roller. The roller of this Example showed a reduction in overdrive sensitivity, as compared to a prior art roller having no stiffening layer and having a compliant layer similar in thickness to that of the total compliant thickness of the prototype roller of this Example.

EXAMPLE 7

Prototype 3 of an ITM Roller Embodiment

An inner compliant blanket layer of a polyurethane was cast on to a cylindrical aluminum core member in a mold, cured and then ground to a thickness of 4.72 mm. The coated core was cooled with the aid of dry ice in order to shrink it, and then an uncooled stiffening layer in the form of an endless cylindrical belt of nickel 40 micrometers thick was applied to the inner compliant blanket by slipping the stiffening layer over the inner blanket. The inner diameter of the nickel belt, which was electroformed and purchased from Stork Screens America, Inc., of Charlotte, N.C., was about 150 micrometers smaller than the outer diameter of the uncooled core with its inner compliant layer. As the cooled core with its inner compliant layer returned to room temperature, the stiffening layer was placed under tension so as to snugly and uniformly clasp the inner compliant layer. An outer compliant blanket layer, about 1 mm thick and composed of a polyurethane doped with an anti-static compound to make its resistivity $1\times10^9$ ohm-cm, was cast in the form of a tube in a centrifugal caster and then cured. The tube was then placed on a mandrel and without grinding was ring-coated with a 6 micrometers thick layer of a ceramer release layer, after which the ceramer was cured. The tube was then removed from the mandrel and pulled on to the stiffening layer, using a compressed air assist technique to elastically stretch the tube slightly during the pulling on operation. After the tube was satisfactorily placed in a suitable position on the stiffening layer, and the compressed air turned off, the tube gripped the stiffening layer snugly, thus forming a completed roller having an outer diameter of 174 mm. The roller was subsequently tested as an intermediate transfer member in an electrophotographic machine, using the stiffening layer to apply transfer voltage, and was found to make satisfactory images on receiver sheets.

EXAMPLE 8

ITM Roller Embodiment

An inner compliant blanket layer of a polyurethane was cast on to a cylindrical aluminum core member in a mold, cured and then ground to a thickness of 4.72 mm. A nickel sleeve, 100 micrometers thick, was placed on an aluminum support (mandrel), in a mold, there was then cast on the nickel sleeve an outer compliant blanket of polyurethane which was then cured. The nickel sleeve was electroformed and purchased from Stork Screens America, Inc., of Charlotte, N.C. Post-curing, the nickel sleeve/polyurethane composite member was ground to a thickness of 1 mm and ring-coated with a 6 micrometers thick layer of a ceramer release layer, after which the ceramer was cured and the composite structure subsequently removed from the aluminum mandrel support. The coated core was cooled with the aid of dry ice in order to shrink it, and then the uncooled nickel sleeve/polyurethane composite member was applied to the inner compliant blanket by slipping the composite member over the inner blanket. The inner diameter of the nickel belt, which was electroformed and purchased from Stork Screens America, Inc., of Charlotte, N.C., was about 150 micrometers smaller than the outer diameter of the uncooled core with its inner compliant layer. As the cooled core with its inner compliant layer returned to room temperature, the nickel sleeve/polyurethane composite member was placed under tension so as to snugly and uniformly clasp the inner compliant layer. The outer compliant blanket layer, 1 mm thick, was composed of a polyurethane doped with an anti-static compound to make its resistivity $1\times10^9$ ohm-cm. A completed roller having an outer diameter of 174 mm was formed. The roller was subsequently tested as an intermediate transfer member in an electrophotographic machine, using the stiffening layer to apply transfer voltage, and was found to make excellent images on receiver sheets.

EXAMPLE 9

ITM Roller Embodiment

A roller was constructed in the same manner as Example 8 with the exception that the inner compliant layer was 8.0 mm thick and the outer compliant layer was 2.0 mm thick. Additionally, the inner diameter of the nickel belt was about 300 to 350 micrometers smaller than the outer diameter of the uncooled core with its inner compliant layer. The roller of Example 5 is preferred over that of Example 8 because of the decreased reaction force produced from a fixed engagement, i.e., a larger nip width is obtained for a given nip pressure.

Overdrive Measurements and Theory Compared for an ITM Roller Embodiment

When a rotating roller having a compliant elastomeric layer forms a pressure nip with a counter-rotating roller using a frictional drive between the rollers, the speed within the nip of the outer surface of the compliant roller, S, is given by the following equation (for small strains):

$$S=S_0(1+\epsilon)$$

where $S_0$ is the tangential peripheral speed far away from the nip, and $\epsilon$ is the surface hoop strain in the contact area of the nip measured parallel to the direction of motion. At a point on the surface of the compliant roller far away from the nip, the tangential peripheral speed is given by:

$$S_0=R\omega$$

where R is the radius of the compliant roller far away from the nip, and $\omega$ is the angular rotational rate around its axis (radians per unit time).

Now considering a compliant ITM roller and a PIFM roller, a peripheral surface speed ratio may be defined equal to the peripheral tangential speed of the PIFM roller far away from the nip divided by the peripheral tangential speed of the compliant ITM roller far away from the nip, one roller frictionally driving the other. It will be evident that the surface velocities within the nip are the same, and one may therefore deduce from the first equation above that this speed ratio is given by:

$$\text{Peripheral Surface Speed Ratio}=S_0^{PIFM}/S_0^{ITM}=(1+\epsilon_{ITM})$$

where it is assumed that, by comparison with the compliant ITM roller, the hard PIFM roller is to all intents and purposes nondeformable, i.e., $\epsilon_{PIFM}\sim 0$. Also, $S_0^{PIFM}$ and $S_0^{ITM}$ are the respective tangential peripheral speeds of the undistorted PIFM and the ITM rollers far away from the nip. An angular speed ratio may also be defined, which is given by:

$$\text{Angular Speed Ratio}=\omega^{PIFM}/\omega^{ITM}=(R^{ITM}/R^{PIFM})(1+\epsilon_{ITM}$$

where $R^{ITM}$ and $R^{PIFM}$ are the respective outer radii of the undistorted ITM and PIFM rollers far away from the nip.

It will be evident that the strain ITM is an increasing function of increasing engagement of the two rollers. When both rollers having parallel axes are in a position such that their surfaces barely touch, engagement is defined as the distance the two axes are moved towards one another from this initial position in the formation of a pressure nip.

By including a stiffening layer in an ITM roller of the invention, sensitivities of the above defined speed ratios to variations in engagement and other process noises are reduced by large amounts. A speed ratio sensitivity is defined by how strongly the speed ratio depends upon any of a multitude of noise factors that may change strain in a transfer nip, such as for example, roller runout, lack of parallelism between rollers, thermal variations, receiver thickness, and so forth. The measure of speed ratio sensitivity is the slope of a graph of the speed ratio as a function of a given noise, e.g. engagement.

To obtain speed ratios and speed ratio sensitivity information for a preferred ITM roller of the invention, the ITM roller of Example 8 was tested experimentally. For a benchmark comparison, the results were compared with measurements using a prior art ITM roller having a similar structure but lacking a stiffening layer. The prior art ITM roller had a rigid aluminum core coated by 5.72 mm of polyurethane as used for the inner compliant layer of Example 8, plus a ceramer overcoat 6 micrometers thick, giving a finished roller having an outer diameter of 174 mm. In a test apparatus, in which the engagement could be controlled and altered, a prior art rigid PIFM photoconductive roller having an outer diameter of 182 mm was used to frictionally drive, in separate experiments, the prior art ITM roller or the ITM roller of Example 8. After setting the engagement to a suitable initial value, speed ratios were measured as a function of increasing engagement with the aid of shaft encoders mounted on each roller axle. One revolution corresponded to 50,000 counts on each shaft encoder. The numbers of counts measured by each encoder after 1 minute of operation at 33 rpm were recorded, and the corresponding speed ratios were computed.

Figure 4:
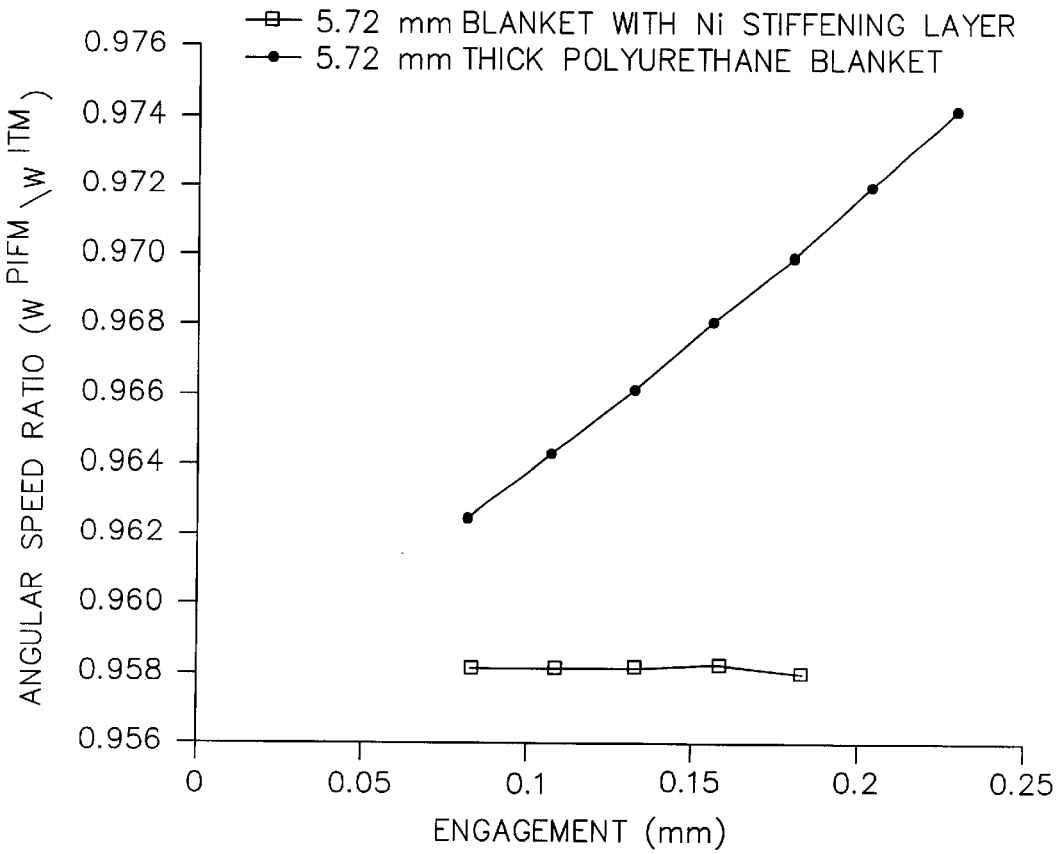
FIG. 4 shows a graphical comparison of angular speed ratios, experimentally measured as functions of engagement produced in a pressure nip between a PIFM and an ITM roller of the invention, as compared to the same PIFM with a prior art ITM roller.

FIG. 4 shows a comparison of angular speed ratios ($\omega^{PIFM}/\omega^{ITM}$) for the two ITM rollers tested, plotted as functions of engagement. Initial values of engagement are known to an accuracy of ±10 micrometers, and changes of engagement are measured with the aid of a linear voltage displacement transducer and are therefore known to a much higher accuracy. FIG. 4 shows that, for engagements greater than about 0.08 mm, the angular speed ratio for the prior art ITM increases rapidly and steadily as engagement is increased, while that for the novel ITM having a stiffening layer changes by only a few parts in ten thousand. This experiment demonstrates the great superiority of the inventive ITM roller over that of the prior art roller, the inventive ITM having a very much lower angular speed ratio sensitivity than that of the prior art.

Figure 5:
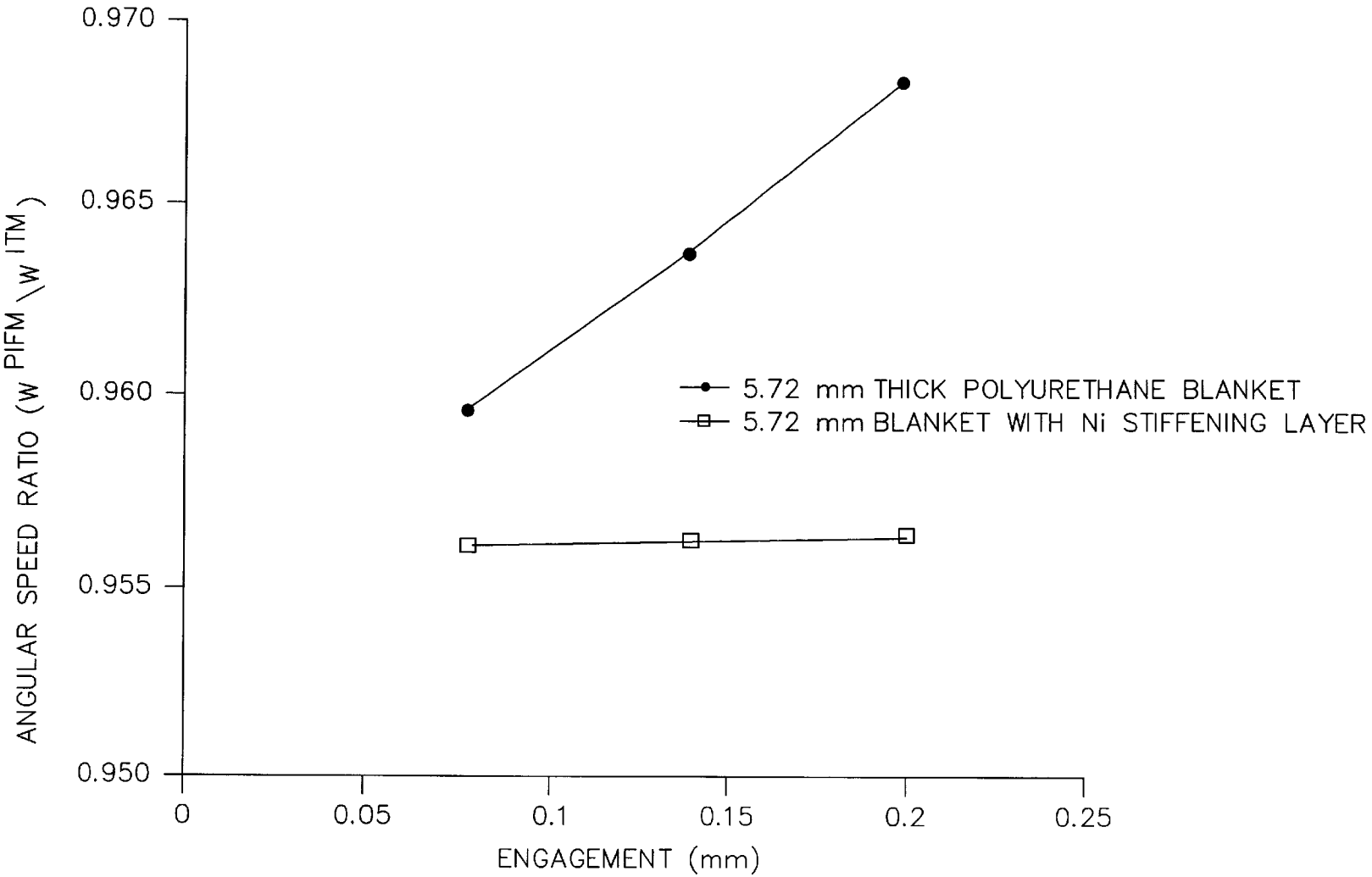
FIG. 5 shows a graphical comparison of angular speed ratios, calculated from a theoretical model, as functions of engagement produced in a pressure nip between a PIFM roller and an ITM roller of the invention, as compared to the same PIFM roller with a prior art ITM roller.

FIG. 5 shows the results of calculations of angular speed ratios made using a computer to solve a finite element model. In the calculations, the PIFM roller is approximated as nondeformable, the characteristics and dimensions of the ITM rollers being otherwise the same as for FIG. 4. In the model, various parameters were chosen to approximate real conditions. Poisson's ratio of each of the compliant blankets was chosen as 0.495, drag was included, and the coefficient of friction between PIFM and ITM was taken to be 0.5. The strain in the stiffening layer for zero engagement was also assumed to be zero, rather than the finite amount of initial strain that was actually present in the roller of Example 4. The results obtained from theory shown in FIG. 5 are in very good agreement with the experimental results of FIG. 4. The model calculations closely support experiment, showing a very much greater dependence of angular speed ratio on engagement for a prior art roller as compared to a roller with a 100 micrometers thick nickel stiffening layer having a Young's modulus of between 100 and 200 GPa. Both curves of FIG. 5 extrapolate for zero engagement to a value close to 0.956, the ratio of roller diameters. Since the angular speed ratio barely alters from this value for the inventive ITM roller with increasing engagement, it is evident that the peripheral speed ratio is predicted to be close to unity for this roller, in agreement with FIG. 4, while the peripheral speed ratio sensitivity is predicted to be close to zero, meaning that the inventive ITM roller contributes negligibly in producing overdrive with a hard roller. Moreover, the results of FIG. 5 demonstrate the utility of the model for estimating the dependence of speed ratio sensitivities upon important variables relating to the stiffening layer.

Figure 6:
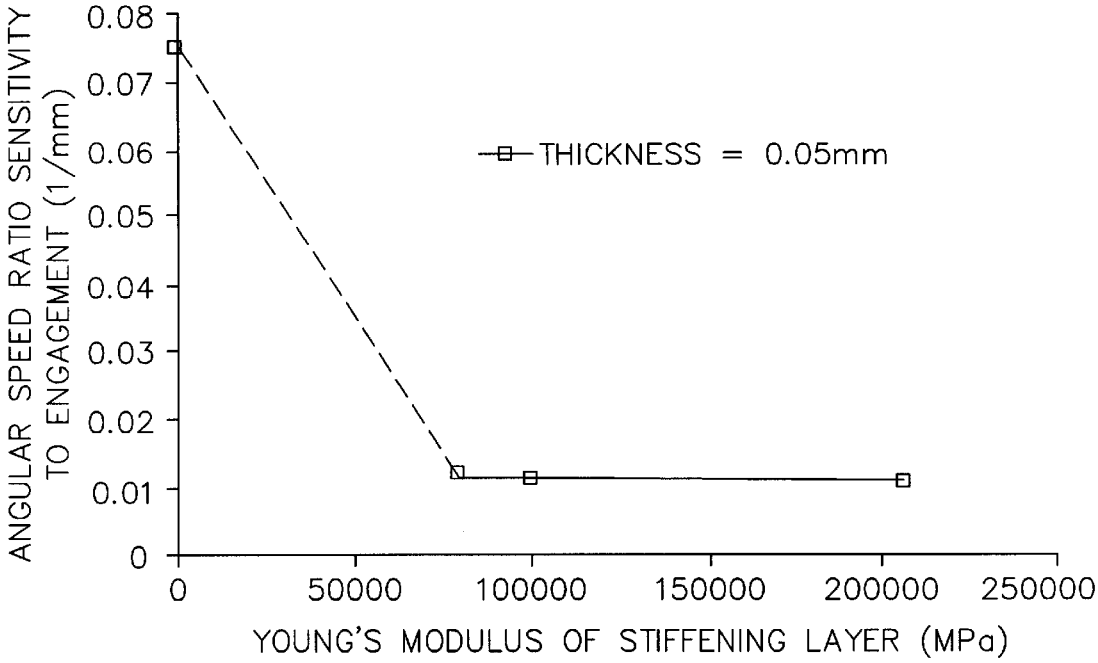
FIG. 6 shows angular speed ratio sensitivity magnitude, for an ITM roller of the invention in a pressure nip with a PIFM roller, calculated from a theoretical model as a function of the Young's modulus of the stiffening layer.

Assuming a hard PIFM roller is frictionally driven by a compliant ITM roller having an inner compliant layer on a rigid core, a stiffening layer, and an outer compliant layer coated on the stiffening layer, FIG. 6 shows theoretical dependence of the magnitude of angular speed ratio sensitivity upon the Young's modulus of the stiffening layer, calculated using the model. The rollers have the same diameters as for FIG. 4. The inner and the outer blanket layers both have a Poisson's ratio equal to 0.495 and a Young's modulus equal to 3.45 MPa. The stiffening layer here has a thickness of 50 micrometers. The inner compliant layer is taken to have a thickness of 4 mm, and the outer compliant layer, 1 mm. Each value of angular speed ratio sensitivity magnitude plotted in FIG. 6 is obtained from the slope of a graph of angular speed ratio versus millimeters of engagement, using a linear regression to fit the calculated angular speed ratio data points. For a hypothetical Young's modulus of the stiffening layer of zero (i.e., a buried stiffening layer is effectively absent, as in prior art ITM rollers) the calculated angular speed ratio sensitivity magnitude is 0.076 $mm^{-1}$. For a stiffening layer with a Young's modulus of 80,000 MPa the angular speed ratio sensitivity falls dramatically by over six-fold to a magnitude of about 0.012 $mm^{-1}$, and then decreases very slowly for higher values Young's modulus. This result shows the beneficial reduction of speed ratio sensitivity obtained by providing a suitably high Young's modulus for the stiffening layer. As indicated by the abrupt change of slope of the dashed line connecting the first two points of the graph, a minimum useful value of Young's modulus of a buried stiffening layer is very probably lower than 80,000 MPa. This suggests that a non-metallic material can be useful as a stiffening layer, e.g., a typical ceramer layer having a Young's modulus of about 1 GPa, or a typical permuthane (polyurethane) having a Young's modulus of about 100 MPa, or some other suitable elastomeric material.

Figure 7:
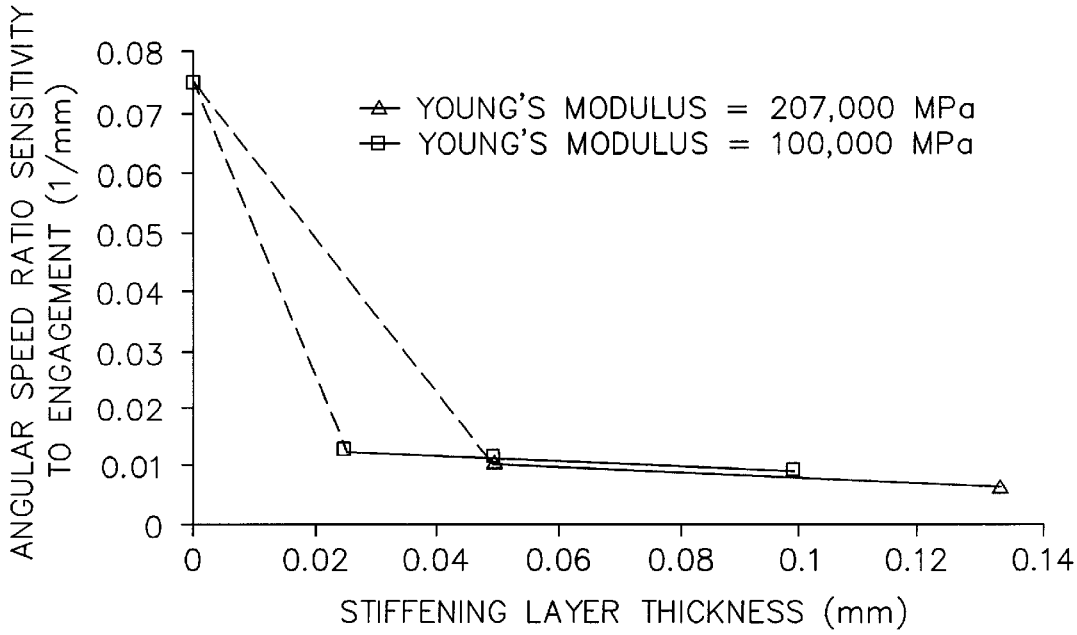
FIG. 7 shows angular speed ratio sensitivity magnitude for an ITM roller of the invention in a pressure nip with a PIFM roller, calculated from a theoretical model as a function of the thickness of the stiffening layer for stiffening layers made from two different metals.

FIG. 7 demonstrates the theoretical dependence of angular speed ratio sensitivity magnitude upon the thickness of the stiffening layer, calculated using the model and again assuming a hard PIFM roller is frictionally driven by a compliant ITM roller having an inner compliant layer on the core, a stiffening layer, and an outer compliant layer coated on the stiffening layer. The inner and the outer blanket layers both have a Poisson's ratio equal to 0.495 and a Young's modulus equal to 3.45 MPa. The two plotted curves are for a zinc stiffening layer (Young's modulus 100,000 MPa) and a steel stiffening layer (Young's modulus 207,000 MPa). For thicknesses exceeding 0.05 mm, the less stiff zinc layer has a somewhat weaker effect in reducing the angular speed ratio sensitivity magnitude, as would be expected. However, both metals are calculated to produce very substantial reductions in angular speed ratio sensitivity magnitude as compared to a stiffening layer of zero thickness, for which the value of angular speed ratio sensitivity magnitude is equal to 0.076 $mm^{-1}$. As indicated by the abrupt changes of slope of the dashed lines connecting the first two points of each curve, a minimum useful value of thickness of a buried stiffening layer is expected to be considerably lower than 25 micrometers (0.025 mm). For steel stiffening layer thicknesses exceeding about 0.133 mm in FIG. 7, an extrapolation of the data to higher thicknesses indicates that the angular speed ratio sensitivity magnitude could decline to values less than about 0.004 $mm^{-1}$, which is about nineteen-fold lower than the sensitivity for an equivalent prior art roller having no stiffening layer.

Great improvements are obtainable in electrostatic transfer by using novel compliant ITMs including a very thin stiffening layer to reduce overdrive sensitivity to manufacturing tolerance variations and process noises. A suitable stiffening layer must not crack or break up into platelets during operation, i.e., its yield strength must not be exceeded. An ITM comprising a stiffening layer can be made to be bifunctional, i.e., it may be used as a primary image-forming member as well as an intermediate transfer member if it is provided with a photoconductive structure comprising one or more layers, in addition to providing the compliancy from one or more compliant layers.

In accordance with the above, and in the following numbered paragraphs below, it is apparent that the inventors have described:

¶1. An intermediate transfer member (ITM) for use in electrostatography comprising:

a rigid cylindrical core member;

a compliant layer covering the core member;

a stiffening layer covering the compliant layer; and wherein the stiffening layer is endless.

¶2. An ITM according to Paragraph 1 wherein the macro-compliance of the compliant multi-layer blanket is not substantially diminished compared to an ITM with no stiffening layer.

¶3. An ITM according to Paragraph 1 and wherein the core member adjacent to the compliant layer comprises a conductive surface that may be connected to a source of voltage or current.

¶4. An ITM according to Paragraph 1 and wherein the compliant layer has a Young's modulus less than 10 MPa.

¶5. An ITM according to Paragraph 1 and wherein the compliant layer has a Young's modulus in a range of approximately 1–5 MPa.

¶6. An ITM according to Paragraph 1 and wherein the compliant layer has a resistivity in a range of approximately $10^7$–$10^{11}$ ohm-cm.

¶7. An ITM according to Paragraph 1 and wherein the compliant layer has a resistivity of about $10^9$ ohm-cm.

¶8. An ITM according to Paragraph 1 and wherein the compliant layer has thickness in a range of approximately 2–20 mm.

¶9. An ITM according to Paragraph 1 and wherein the stiffening layer has a thickness in a range of greater than 50 and up to 1,000 micrometers and wherein the yield strength of the stiffening layer is not exceeded.

¶10. An ITM according to Paragraph 9 and wherein the stiffening layer remains a continuous belt that does not crack or break up into platelets during operation.

¶11. An ITM according to Paragraph 9 and wherein the stiffening layer is a seamless endless belt which remains a continuous belt that does not crack or break up into platelets during operation.

¶12. An ITM according to Paragraph 1 and wherein the stiffening layer has a resistivity in a range of approximately $10^7$–$10^{11}$ ohm-cm.

¶13. An ITM according to Paragraph 1 and wherein the stiffening layer has a resistivity of about $10^9$ ohm-cm.

¶14. An ITM according to Paragraph 1 and wherein the stiffening layer has a Young's modulus in a range of approximately 0.1–300 GPa.

¶15. An ITM according to Paragraph 1 and wherein the stiffening layer has a Young's modulus in a range of approximately 0.5–200 GPa.

¶16. An intermediate transfer member (ITM) for use in electrostatography comprising:

a rigid cylindrical core member;

a compliant layer covering the core member;

a stiffening layer covering the inner compliant layer;

a release layer covering the stiffening layer;

wherein, the core member comprises a conductive surface adjacent to the compliant layer that may be connected to a source of voltage or current, the stiffening layer comprises an endless belt, the compliant layer has a Young's modulus less than 10 MPa, a thickness in a range of approximately 2–20 mm, and a resistivity in a range of approximately $10^7$–$10^{11}$ ohm-cm, the stiffening layer has a thickness in a range of approximately 10–1,000 micrometers, a resistivity in a range of approximately $10^7$–$10^{11}$ ohm-cm, and a Young's modulus in a range of approximately 0.1–300 GPa.

¶17. An ITM according to Paragraph 16 wherein the stiffening layer is seamless.

¶18. An ITM according to Paragraph 16 and wherein the release layer has a thickness in a range of approximately 1–50 micrometers.

¶19. An ITM according to Paragraph 16 and wherein the release layer has a thickness in a range of approximately 4–15 micrometers.

¶20. An ITM according to Paragraph 16 and wherein the release layer has a Young's modulus greater than 100 MPa.

¶21. An ITM according to Paragraph 16 and wherein the release layer has a resistivity in a range of approximately $10^7$–$10^{13}$ ohm-cm.

¶22. An ITM according to Paragraph 16 and wherein the release layer has a resistivity of about $10^{10}$ ohm-cm.

¶23. An intermediate transfer member (ITM) for use in electrostatography comprising:

a rigid cylindrical core member;

an inner compliant layer covering said core member;

a stiffening layer covering said inner compliant layer;

an outer compliant layer covering said stiffening layer;

a release layer covering said outer compliant layer; and wherein the stiffening layer comprises an endless belt.

¶24. An ITM according to Paragraph 23 and wherein the core member comprises a conductive surface adjacent to the inner compliant layer that may be connected to a source of voltage or current.

¶25. An ITM according to Paragraph 23 and wherein the inner compliant layer has a Young's modulus less than 10 MPa.

¶26. An ITM according to Paragraph 23 and wherein the inner compliant layer has a Young's modulus in a range of approximately 1–5 MPa.

¶27. An ITM according to Paragraph 23 and wherein the inner compliant layer a Poisson's ratio in a range of approximately 0.2–0.5.

¶28. An ITM according to Paragraph 27 and wherein the inner compliant layer has a Poisson's ratio in a range of approximately 0.45–0.50.

¶29. An ITM according to Paragraph 23 and wherein the inner compliant layer has a resistivity in a range of approximately $10^7$–$10^{11}$ ohm-cm.

¶30. An ITM according to Paragraph 23 and wherein the inner compliant layer has a resistivity of about $10^9$ ohm-cm.

¶31. An ITM according to Paragraph 23 and wherein the inner compliant layer has thickness in a range of approximately 2–20 mm.

¶32. An ITM according to Paragraph 23 and wherein the stiffening layer is a seamless endless belt.

¶33. An ITM according to Paragraph 23 and wherein the stiffening layer has a thickness in a range of approximately 10–300 micrometers.

¶34. An ITM according to Paragraph 23 and wherein the stiffening layer has a resistivity less than about $10^{10}$ ohm-cm.

¶35. An ITM according to Paragraph 23 wherein the stiffening layer has a resistivity less than about $10^5$ ohm-cm.

¶36. An ITM according to Paragraph 23 and wherein the stiffening layer has a Young's modulus greater than 0.1 GPa.

¶37. An ITM according to Paragraph 23 and wherein the stiffening layer has a Young's modulus in a range of approximately 50–300 GPa.

¶38. An ITM according to Paragraph 23 and wherein the stiffening layer may be connected to a source of voltage or current.

¶39. An ITM according to Paragraph 23 and wherein the outer compliant layer has Young's modulus less than 10 MPa.

¶40. An ITM according to Paragraph 23 and wherein the outer compliant layer has Young's modulus in a range of approximately 1–5 MPa.

¶41. An ITM according to Paragraph 23 and wherein a ratio of a thickness of the outer compliant layer divided by a thickness of the inner compliant layer is less than 1.0.

¶42. An ITM according to Paragraph 41 wherein said ratio is less than about 0.3.

¶43. An ITM according to Paragraph 23 and wherein the outer compliant layer has thickness in a range of approximately 0.5–4 mm.

¶44. An ITM according to Paragraph 23 and wherein the outer compliant layer has a resistivity in a range of approximately 107–$10^{11}$ ohm-cm.

¶45. An ITM according to Paragraph 23 and wherein the outer compliant layer has a resistivity of about $10^9$ ohm-cm.

¶46. An ITM according to Paragraph 23 and wherein the release layer has a thickness in a range of approximately 1–50 micrometers.

¶47. An ITM according to Paragraph 23 and wherein the release layer has a thickness in a range of approximately 4–15 micrometers.

¶48. An ITM according to Paragraph 23 and wherein the release layer has a Young's modulus greater than 100 MPa.

¶49. An ITM according to Paragraph 23 and wherein the release layer has a resistivity in a range of approximately $10^7$–$10^{13}$ ohm-cm.

¶50. An ITM according to Paragraph 23 and wherein the release layer has a resistivity of about $10^{10}$ ohm-cm.

¶51. An ITM according to Paragraph 23 and wherein the stiffening layer is an endless belt that is seamless.

¶52. An intermediate transfer apparatus comprising:

a moving primary image-forming member (PIFM);

a moving intermediate transfer member (ITM);

a pressure contact engagement between the PIFM and the ITM to create a nip width;

means for providing in the nip width an electrical transfer field for electrostatically transferring a marking particle toner image formed on the PIFM to the ITM; and wherein the ITM comprises a roller including a rigid cylindrical core member, an inner compliant layer covering the core member, a stiffening layer comprising an endless belt covering the inner compliant layer, an outer compliant layer covering the stiffening layer, a release layer covering the outer compliant layer.

¶53. An intermediate transfer apparatus according to Paragraph 52 and wherein:

said rigid cylindrical core member further comprises a conductive surface adjacent to the inner compliant layer that may be connected to a source of voltage or current;

said inner compliant layer covering the core member further comprises a Young's modulus in a range of approximately 1–5 MPa, a Poisson's ratio in a range of approximately 0.2–0.5, a resistivity of about $10^9$ ohm-cm, and a thickness in a range of approximately 2–20 mm;

said stiffening layer covering the inner compliant layer further comprises a thickness in a range 10–300 micrometers, a resistivity less than about $10^{10}$ ohm-cm, a Young's modulus in a range of approximately 50–300 GPa;

said outer compliant layer covering the stiffening layer further comprises a Young's modulus in a range 1–5 MPa, a thickness in a range of approximately 0.5–4 mm, and a resistivity of about $10^9$ ohm-cm; and said release layer covering the outer compliant layer further comprises a thickness in a range of approximately 4–15 micrometers, a Young's modulus greater than 100 MPa, and a resistivity of about $10^{10}$ ohm-cm.

¶54. An intermediate transfer apparatus according to Paragraph 52 and wherein the stiffening layer is a seamless endless belt.

¶55. An intermediate transfer apparatus according to Paragraph 52 and wherein the stiffening layer may be connected to a source of voltage or current.

¶56. An intermediate transfer apparatus according to Paragraph 52 and wherein a ratio of a thickness of the outer compliant layer divided by a thickness of the inner compliant layer is less than 1.0.

¶57. An intermediate transfer apparatus according to Paragraph 56 wherein said ratio is less than about 0.3.

¶58. A reproduction apparatus comprising:

a moving primary image-forming member (PIFM);

a moving intermediate transfer member (ITM);

means to provide a pressure contact engagement between the PIFM and the ITM to create a first nip width;

means for providing in said first nip width an electrical transfer field for electrostatically transferring a marking particle toner image formed on the PIFM to the ITM;

a moving receiver member;

means to provide a pressure contact engagement between the ITM and the receiver member to create a second nip width;

means for providing in the second nip width an electrical transfer field for electrostatically transferring a marking particle toner image from the ITM to the receiver member;

wherein the ITM is a roller that comprises at least one compliant layer and further comprises a stiffening layer having the form of an endless belt located above one of said at least one compliant layer and wherein the yield strength of the stiffening layer is not exceeded, the stiffening layer remaining as a continuous belt which does not crack or break up into platelets during operation.

¶59. A reproduction apparatus according to Paragraph 58 and wherein the stiffening layer is a seamless endless belt.

¶60. A moving intermediate transfer member according to Paragraph 58 and wherein the stiffening layer has a thickness in a range of approximately 10–1,000 micrometers.

¶61. A moving intermediate transfer member according to Paragraph 58 and wherein the stiffening layer has a resistivity less than about $10^{11}$ ohm-cm.

¶62. A moving intermediate transfer member according to Paragraph 58 and wherein the stiffening layer has a resistivity in a range of approximately $10^{7}$–$10^{11}$ ohm-cm.

¶63. A moving intermediate transfer member according to Paragraph 58 and wherein the stiffening layer has a resistivity of about $10^{9}$ ohm-cm.

¶64. A moving intermediate transfer member according to Paragraph 58 and wherein the stiffening layer has a Young's modulus in a range of approximately 0.1–300 GPa.

¶65. A moving intermediate transfer member according to Paragraph 58 and wherein the stiffening layer may be connected to a source of voltage or current.

¶66. A toner transfer method comprising:

forming a toner image on a primary image-forming member; and electrostatically transferring the toner image from the primary image-forming member to an intermediate transfer member in a transfer nip produced by a pressure contact between the primary image-forming member and the intermediate transfer member, an electric field urging the toner image from the primary image-forming member to the intermediate transfer member, the intermediate transfer member comprising at least one compliant layer and further comprising a stiffening layer having the form of an endless belt located above one of said at least one compliant layer and wherein the yield strength of the stiffening layer is not exceeded, the stiffening layer remaining as a continuous belt which does not crack or break up into platelets during operation.

¶67. A toner transfer method according to Paragraph 66 and wherein the stiffening layer is a seamless endless belt.

¶68. The toner transfer method according to Paragraph 66 and wherein the stiffening layer has a thickness in a range of approximately 10–1,000 micrometers.

¶69. The toner transfer method according to Paragraph 66 and wherein the stiffening layer has a resistivity less than about $10^{11}$ ohm-cm.

¶70. The toner transfer method according to Paragraph 66 and wherein the stiffening layer has a resistivity in a range of approximately $10^{7}$–$10^{11}$ ohm-cm.

¶71. The toner transfer method according to Paragraph 66 and wherein the stiffening layer has a resistivity of about $10^{9}$ ohm-cm.

¶72. The toner transfer method according to Paragraph 66 and wherein the stiffening layer has a Young's modulus in a range of approximately 0.1–300 GPa.

¶73. A toner transfer method comprising:

forming a toner image on a moving primary image-forming member;

electrostatically transferring the toner image from the moving primary image-forming member to a moving intermediate transfer member in a transfer nip produced by a pressure contact between the primary image-forming member and the intermediate transfer member, an electric field urging the toner image from the primary image-forming member to the intermediate transfer member, the intermediate transfer member comprising a rigid cylindrical core member, an inner compliant layer covering the core member, a stiffening layer in the form of an endless belt covering the inner compliant layer, an outer compliant layer covering the stiffening layer, a release layer covering the outer compliant layer.

¶74. A toner transfer method according to Paragraph 73 and wherein the stiffening layer is a seamless endless belt.

¶75. The toner transfer method according to Paragraph 73 and wherein:

said inner compliant layer covering the core member further comprises a Young's modulus in a preferred range of approximately 1–5 MPa, a Poisson's ratio in a range of approximately 0.2–0.5, a resistivity of about $10^{9}$ ohm-cm, and a thickness in a range of approximately 2–20 mm, said stiffening layer covering the inner compliant layer further comprises a thickness in a preferred range of approximately 10–300 micrometers, a resistivity less than about $10^{10}$ ohm-cm, a Young's modulus in a preferred range of approximately 50–300 GPa, said outer compliant layer covering the stiffening layer further comprises a Young's modulus in a range 1–5 MPa, a thickness in a range of approximately 0.5–4 mm, and a resistivity of about $10^{9}$ ohm-cm, said release layer covering the outer compliant layer further comprises a thickness in a range of approximately 4–15 micrometers, a Young's modulus greater than 100 MPa, and a resistivity of about $10^{10}$ ohm-cm.

¶76. The toner transfer method according to Paragraph 73 and wherein said rigid cylindrical core member further comprises a conductive surface adjacent to the inner compliant layer that may be connected to a source of voltage or current.

¶77. The toner transfer method according to Paragraph 73 and wherein means are provided to connect the stiffening member to a source of voltage or current.

¶78. A reproduction method comprising:

forming a toner image on a moving primary image-forming member;

electrostatically transferring the toner image from the moving primary image-forming member to a moving intermediate transfer member in a first transfer nip produced by a pressure contact between the primary image-forming member and the intermediate transfer member, an electric field urging the toner image from the primary image-forming member to the intermediate transfer member, the intermediate transfer member comprising a rigid cylindrical core member, an inner compliant layer covering the core member, a stiffening layer in the form of an endless belt covering the inner compliant layer, an outer compliant layer covering the stiffening layer, a release layer covering the outer compliant layer; and electrostatically transferring the toner image from the moving intermediate transfer member to a moving receiver member in a second transfer nip produced by a pressure contact between the ITM and the receiver, the receiver member backed by a pressure transfer roller, an electric field between the ITM and the pressure transfer roller urging transfer of the toner image from the ITM to the receiver, the receiver in the form of a sheet carried by a moving transport web passing through the second transfer nip.

The invention has been described in detail with reference to presently preferred embodiments, but it will be understood that variations and modifications can be effected within the spirit and scope of the invention.

What is claimed is:

1. An intermediate transfer member (ITM) roller for use in an electrostatographic recording apparatus comprising:

a core member;

a compliant layer covering the core member; and a stiffening layer covering the compliant layer, wherein the stiffening layer includes an endless belt that has a thickness in the range of greater than 50 and up to 1000 micrometers.

2. The ITM roller of claim 1 wherein the compliant layer has a Young's modulus between 0.1 MPa and 10 MPa and a thickness in the range of 2–20 mm.

3. The ITM roller of claim 2 wherein the stiffening layer is a metal.

4. The ITM roller of claim 2 wherein the stiffening layer has a Young's modulus in a range of 0.1–300 GPa.

5. The ITM roller of claim 2 and including a release layer covering the stiffening layer.

6. The ITM roller of claim 5 wherein the compliant layer has a resistivity in a range of 10exp7–10exp11.

7. The ITM roller of claim 6 wherein the stiffening layer is seamless.

8. The ITM roller of claim 3 wherein the stiffening layer is seamless.

9. The ITM roller of claim 1 wherein the compliant layer has a Poisson's ratio in the range of 0.45–0.50.

10. The ITM roller of claim 9 wherein the stiffening layer is a metal.

11. The ITM roller of claim 9 wherein the compliant layer has a thickness in the range of 2–20 mm and a Young's modulus in a range of 0.1–10 MPa, the compliant layer has a resistivity in a range of 10exp7–10exp11 ohm-cm, the compliant layer is substantially incompressible so that it conserves volume when deformed, and the stiffening layer is a seamless endless belt and the stiffening layer has a resistivity in a range of 10exp7–10exp11 ohm-cm and a Young's modulus of 0.1–300 GPa.

12. The ITM roller of claim 11 and wherein a release layer covers the stiffening layer, and the release layer has a resistivity in a range of 10exp7–10exp13 and a Young's modulus greater than 100 MPa.

13. The ITM roller of claim 1 wherein the compliant layer has Poisson's ratio in the range of 0.2–0.50.

14. The ITM roller of claim 13 wherein the stiffening layer is a metal.

15. The ITM roller of claim 13 wherein the compliant layer has a thickness in the range of 2–20 mm and a Young's modulus in a range of 0.1–10 MPa, the compliant layer has a resistivity in a range of 10exp7–10exp11 ohm-cm, the compliant layer is substantially incompressible so that it conserves volume when deformed, and the stiffening layer is a seamless endless belt and the stiffening layer has a resistivity in a range of 10exp7–10exp11 ohm-cm and a Young's modulus of 0.1–300 GPa.

16. The ITM roller of claim 15 and wherein a release layer covers the stiffening layer, and the release layer has a resistivity in a range of 10exp7–10exp13 and a Young's modulus greater than 100 MPa.

17. An intermediate transfer member (ITM) roller for use in an electrostatographic recording apparatus comprising:

a core member;

an inner compliant layer covering the core member;

a stiffening layer covering the compliant layer, wherein the stiffening layer comprises an endless belt that has a thickness in the range of 10–1000 micrometers; and an outer compliant layer covering the stiffening layer.

18. The ITM roller of claim 17 wherein the inner compliant layer has a Poisson's ratio in the range of 0.2–0.50.

19. The ITM roller of claim 17 wherein the inner compliant layer has a Poisson's ratio in the range of 0.45–0.50.

20. The ITM roller of claim 19 wherein the inner compliant layer has a thickness in the range of 2–20 mm and a Young's modulus in a range of 0.1–10 MPa, the inner compliant layer has a resistivity in a range of 10exp7–10exp11 ohm-cm, the inner compliant layer is substantially incompressible so that it conserves volume when deformed, and the stiffening layer is a seamless endless belt having a thickness in a range of 10–1000 micrometers and a Young's modulus of 0.1–300 GPa.

21. The ITM roller of claim 17 wherein the inner compliant has a Young's modulus of 3.5 MPa+/−1.0 MPa, the stiffening layer is seamless and has a thickness of 100 micrometers+/−5 micrometers a Young's modulus of 210 GPa+/−10 GPa, the outer compliant layer has a Young's modulus of 3.5 MPa+/−1.0 MPa.

22. The ITM roller of claim 1 further comprising indicia located on the ITM roller, wherein the indicia are provided to indicate a parameter relative to the ITM roller.

23. The ITM roller of claim 22 wherein the indicia are of the type that may be detected by an indicia detector either visually, mechanically, electrically, optically, magnetically or by means of radio frequency.

24. The ITM roller of claim 17 further comprising indicia located on the ITM roller, wherein the indicia are provided to indicate a parameter relative to the ITM roller.

25. The ITM roller of claim 24 wherein the indicia are of the type that may be detected by an indicia detector either visually, mechanically, electrically, optically, magnetically or by means of radio frequency.

26. A method of forming an image on a receiver member comprising:

forming a toner image on a primary image forming member in an electrostatographic machine;

transferring the toner image under pressure in a primary transfer nip to an ITM roller as claimed in claim 1; and transferring the toner image in a secondary transfer nip from the ITM roller to the receiver member.

27. A method of forming an image on a receiver member comprising:

forming a toner image on a primary image forming member in an electrostatographic machine;

transferring the toner image under pressure in a primary transfer nip to an ITM roller as claimed in claim 17; and transferring the toner image in a secondary transfer nip from the ITM roller to the receiver member.

28. The method of claim 27 and wherein the stiffening layer is a metal and an electrical bias is provided on the stiffening layer to generate an electrical field for electrostatically attracting toner formed on the primary image forming member to the ITM roller.

29. An apparatus for forming an image on a receiver member, the apparatus comprising:

a primary image forming member that supports a toner image;

an ITM roller as claimed in claim 17 that forms a first transfer nip with the primary image forming member to transfer the toner image to the ITM roller; and a support that supports the receiver member in a second transfer nip with the ITM roller to transfer the toner image from the ITM roller to the receiver member.

* * * * *